US006263172B1

(12) United States Patent
Suzuki et al.

(10) Patent No.: US 6,263,172 B1
(45) Date of Patent: Jul. 17, 2001

(54) IMAGE HEATING APPARATUS WITH IMPROVED START OF FILM DRIVING

(75) Inventors: Masahiro Suzuki, Numazu; Atsuyoshi Abe, Susono, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/494,301

(22) Filed: Jan. 31, 2000

(30) Foreign Application Priority Data

Feb. 1, 1999 (JP) ..... 11-023904

(51) Int. Cl.[7] ..... G03G 15/20

(52) U.S. Cl. ..... 399/67; 219/619; 219/671; 399/328; 399/330

(58) Field of Search ..... 219/216, 619, 219/670, 671; 399/67, 68, 69, 328, 329, 330

(56) References Cited

U.S. PATENT DOCUMENTS

| | | | | |
|---|---|---|---|---|
| 5,534,987 | | 7/1996 | Ohtsuka et al. | 355/285 |
| 5,552,582 | | 9/1996 | Abe et al. | 219/619 |
| 5,552,874 | | 9/1996 | Ohtsuka et al. | 355/285 |
| 5,568,240 | | 10/1996 | Ohtsuka | 355/285 |
| 5,745,833 | | 4/1998 | Abe et al. | 399/330 |
| 5,819,150 | | 10/1998 | Hayasaki et al. | 399/330 |
| 5,881,349 | | 3/1999 | Nanataki et al. | 399/328 |
| 5,940,655 | | 8/1999 | Sano et al. | 399/69 |
| 5,970,299 | | 10/1999 | Sano et al. | 399/330 |
| 6,031,215 | | 2/2000 | Nanataki et al. | 219/619 |
| 6,049,691 | * | 4/2000 | Abe et al. | 399/330 |
| 6,078,781 | * | 6/2000 | Takagi et al. | 399/330 |

FOREIGN PATENT DOCUMENTS 5-027619 2/1993 (JP) .

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

The present invention relates to an image heating apparatus in which a driving member drives a film at a first speed when driving is started and then drives film at a second speed, and the first speed is lower than the second speed.

18 Claims, 15 Drawing Sheets

IMAGE HEATING APPARATUS WITH IMPROVED START OF FILM DRIVING

BACKGROUND OF THE INVENTION

1. Field of the Invention

The present invention relates to an image forming apparatus such as a copying machine or a printer, and particularly to an image heating apparatus applied to the apparatus.

2. Related Background Art

In an image forming apparatus, conventionally a thermal-roller type apparatus has been widely used as a fixing apparatus for heating and fixing an unfixed toner image indirectly or directly formed and borne on a recording material in appropriate image forming process means such as an electrophotography process on a surface of the recording material as a permanently fixed image.

In recent years from a viewpoint of quick starting or energy saving, there are suggested a film-heating type apparatus and an electromagnetic induction heating type apparatus in which a metal film generates heat by itself.

In Japanese Utility Model Application Laid-Open No. 51-109739, there is disclosed an induction heating fixing apparatus for inducing eddy-current on a metal layer (a heat generating layer) of a fixing film by using magnetic flux so as to make the film emit heat with the Joule heat. This apparatus allows the fixing film to emit heat directly by utilizing a generation of induced current, thereby achieving a fixing process efficiency higher than that of a thermal-roller type fixing apparatus having a heat source of a halogen lamp.

In addition, to obtain energy which affects a fixing process very efficiently, an excitation coil is brought close to a fixing film which is a heat generating member or an alternating magnetic flux distribution of an excitation coil is focused in a vicinity of a fixing nip, by which a fixing apparatus in which the energy can be obtained very efficiently has been devised.

In FIG. 19, there is provided an example of an outline configuration of an electromagnetic induction heating type fixing apparatus in which an alternating magnetic flux distribution of an excitation coil is focused on a fixing nip so as to improve an efficiency.

A cylindrical fixing film 10 is a rotator having an electromagnetic induction heat generating layer (a conductive layer, a magnetic layer, or a resistive layer).

The cylindrical fixing film 10 is loosely and externally coupled to a film guide member 16 having a cross-section almost semi-arc guttering shape.

Magnetic field generating means 15 arranged inside the film guide member 16 comprise an excitation coil 18 and E-shaped magnetic core (core material) 17.

An elastic pressurizing roller 30 is contacted with a predetermined contact pressure to a lower surface of the film guide member 16 with the fixing film 10 put therebetween so as to form a fixing nip portion N having a predetermined width.

The magnetic core 17 of the magnetic field generating means 15 is arranged so as to be associated with the fixing nip portion N.

The pressurizing roller 30 is driven by driving means M to rotate counterclockwise indicated by an arrow. The rotative driving of the pressurizing roller 30 affects the fixing film 10 with a rotary force due to a frictional force between the pressurizing roller 30 and an external surface of the fixing film 10, by which the fixing film 10, while sliding with its inner surface in closely contact with a lower surface of the film guide member 16 in the fixing nip portion N, rotates in a clockwise direction indicated by an arrow on an outer periphery of the film guide member 16 at a circumferential speed almost corresponding to a circumferential speed of the pressurizing roller 30 (in a pressurizing roller driving method).

The film guide member 16 applies a pressure to the fixing nip portion N. supports the excitation coil 18 and the magnetic core 17 as the magnetic field generating means 15, supports the fixing film 10, and keeps a conveyance stability at a rotation of the film 10. This film guide member 16 is made of insulating material which does not prevent a passage of magnetic flux and can sustain higher levels of load.

The excitation coil 18 generates alternating magnetic flux by an alternating current supplied from an excitation circuit which is not shown. The alternate magnetic flux is distributed intensively in the fixing nip portion N by means of the E-shaped magnetic core 17 corresponding to a position of the fixing nip portion N and the alternate magnetic flux generates an eddy-current on the electromagnetic induction heat generating layer of the fixing film 10. This eddy-current generates a Joule heat by means of a specific resistance of the electromagnetic induction heat generating layer. The electromagnetic induction heat generation of the fixing film 10 is intensively generated in the fixing nip portion N where the alternate magnetic flux is intensively distributed, by which the fixing nip portion N is heated very efficiently.

A temperature of the fixing nip portion N is kept at a predetermined temperature by a control of a power supply to the excitation coil 17 with a temperature control system including temperature detecting means which is not shown.

The pressurizing roller 30 is driven to rotate in this manner, with which the cylindrical fixing film 10 rotates on the outer periphery of the film guide member 16, and the electromagnetic induction heat generation occurs in the fixing film 10 by the power supply to the excitation coil 17 from the excitation circuit, by which a temperature in the fixing nip portion N rises to a predetermined level. In a temperature-controlled state, a recording material P bearing an unfixed toner image t conveyed from image forming means (not shown) is introduced with its image surface facing upward between the fixing film 10 of the fixing nip portion N and the pressurizing roller 30, in other words, so as to be opposite to the fixing film surface. In the fixing nip portion N, the recording material with the image surface put in closely contact with the outer surface of the fixing film 10 is pinched and conveyed therewith in the fixing nip portion N. In this process in which the recording material P is pinched and conveyed together with the fixing film 10 in the fixing nip portion N, the unfixed toner image t on the recording material P is heated and fixed by the electromagnetic induction heat generation of the fixing film 10. The recording material P is separated from the outer surface of the rotary fixing film 10 after passing the fixing nip portion N and then discharged.

In the fixing apparatus having the above configuration in which a film is used as a rotary member, however, there are problems described below.

Namely, a high driving load is applied since the inner surface of the film rubs against the supporting member during the rotation of the film. To reduce the driving load, it is very important to reduce a dynamic frictional resistance between the inner surface of the film and its supporting member. Therefore, as suggested in the Japanese Patent application Laid-Open No. 5-27619, for example, lubricant such as heat resistant grease is put between the inner surface of the film and its supporting member, by which slidability is secured. In addition, a rib is arranged on the film supporting member to reduce a contact area between the film and its supporting member, by which slidability is secured.

When the film is driven to rotate from a resting condition, however, a static frictional force greater than a dynamic frictional force occurs, which causes a frictional resistance greater than that during the driving operation. At the first rising after the fixing apparatus is mounted on the image forming apparatus body, a very great torque may easily occur immediately after starting the rotative driving due to a backlash of a driving gear, in other words, a play between tooth faces of the gear. In addition, at rising in a condition in which the fixing apparatus is cooled down to a room temperature, a temperature of heat-resistant grease is low and its viscosity is high, thus causing a viscosity resistance greater than that under a temperature control with the film generating heat. Furthermore, at the rising, torque is caused by a necessity of accelerating a circumferential speed from the resting condition to a predetermined process speed.

As described above, at the rising of the fixing apparatus, in other words, at starting a rotation drive, a very large driving torque is required in comparison with that at constant speed driving after the rising. Accordingly, there have been problems that the fixing film slips against a rotation of the pressurizing roller and that a driving motor for the fixing apparatus steps out. The latter problem can be solved by adopting a motor having a greater driving torque, but there is a problem that a product cost increases.

Particularly in a fixing apparatus of a color image forming apparatus for fixing a full-color image having a large amount of mounted toner, however, a nip width need be elongated to improve a fixing performance. In addition, to improve a transmission of an OHT image, preferably a surface pressure of the nip portion is also increased. To satisfy these conditions, it is preferable to apply a pressure larger than that of a conventional fixing apparatus for mono-color images to the nip portion, by which a surface pressure between a rotator in the nip portion and its supporting member is further increased and a frictional resistance is particularly large. These problems described above are very serious in a color image forming apparatus.

SUMMARY OF THE INVENTION

Therefore it is an object of the present invention to provide an image heating apparatus in which a film is driven without a step-out of a driving member.

It is another object of the present invention to provide an image heating apparatus in which a film is not slipped.

It is still another object of the present invention to provide an image heating apparatus comprising a movable film, magnetic flux generating means for generating magnetic flux, a statically fixed supporting member for supporting said film, and a driving member for driving said film, wherein eddy-current occurs on said film due to magnetic flux generated by said magnetic flux generating means, said film generates heat due to the eddy-current, an image on a recording material is heated by heat on the film, said film slides over said supporting member, said driving member drives said film at a first speed at a start of the driving and then drives said film at a second speed, and said first speed is lower than the second speed.

It is further object of the present invention to provide an image heating apparatus comprising a movable film, magnetic flux generating means for generating magnetic flux, a statically fixed supporting member for supporting said film, and a driving member for driving said film, wherein eddy-current occurs on said film due to magnetic flux generated by said magnetic flux generating means, said film generates heat due to the eddy-current, an image on a recording material is heated by heat on the film, said film slides over said supporting member via lubricant, said driving member drives said film after the film generates the heat.

Other objects besides those discussed above shall be apparent from the description below.

DETAILED DESCRIPTION OF THE PREFERRED EMBODIMENTS

Embodiments of the present invention will described below by reference to accompanying drawings.

Figure 1:
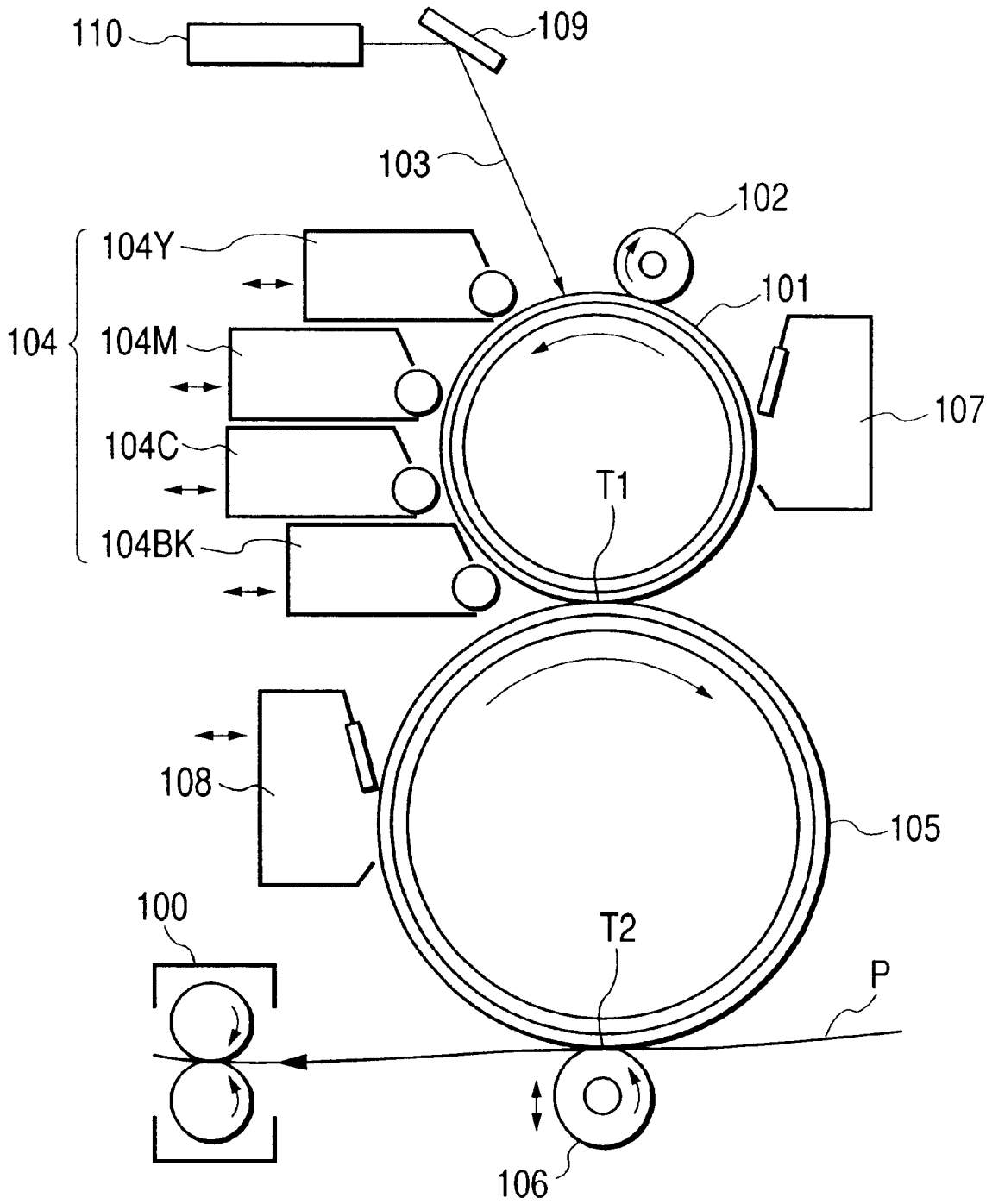
FIG. 1 is a schematic configuration diagram of an image forming apparatus to which an image heating apparatus according to the present invention is applicable.

Referring to FIG. 1, there is shown a schematic configuration diagram showing an example of an image forming apparatus. The image forming apparatus of this example is a color laser printer.

A photosensitive drum (an image bearing member) 101, which is made of an organic photosensitive member or an amorphous silicon photosensitive member, is driven to rotate counterclockwise as indicated by an arrow at a predetermined process speed (circumferential speed).

The photosensitive drum 101 is uniformly charged at predetermined polarity and potential by a charging device 102 such as a charging roller in its rotation process.

Next, the charged surface is subjected to a scanning and exposure processing of target image information with a laser beam 103 output from a laser optical box (laser scanner) 110. The laser optical box 110 outputs a laser beam 103 which has been modulated (on/off) so as to be associated with a time-series electric digital pixel signal of the target image information from an image signal generating device such as an image reader which is not shown, by which a latent image is formed correspondingly to the target image information for which the scanning and exposure is performed on the surface of the photosensitive drum 101. A mirror 109 is used to deflect an output laser beam from the laser optical box 110 to an exposure position of the photosensitive drum 101.

In forming a full color image, scanning and exposure and a latent image formation are performed for a first color separation component image of a target full color image such as, for example, an yellow component image and then its latent image is developed as an yellow toner image with an operation of an yellow developing device 104Y among four color developing devices 104. The yellow toner image is transferred to a surface of an intermediate transfer drum 105 in a primary transfer portion Tl which is a contact portion (or a vicinity portion) between the photosensitive drum 101 and the intermediate transfer drum 105. The surface of the photosensitive drum 101 immediately after the toner image transfer opposed to the surface of the intermediate transfer drum 105 is cleaned by a cleaner 107 with removing adhering residue such as transfer residual toner (residual toner after transfer).

The above process cycle of charging, scanning and exposure, developing, primary transfer, and cleaning is sequentially executed for respective color separation component images such as a second color separation component image (for example, a magenta component image, with an operation of a magenta developing unit 104M), a third color separation component image (for example, a cyan component image, with an operation of a cyan developing unit 104C), and a fourth color separation component image (for example, a black component image, with an operation of a black developing unit 104BK), and four color toner images of an yellow toner image, a magenta toner image, a cyan toner image, and a black toner image are sequentially superposed and transferred on the surface of the intermediate transfer drum 105, so that a color toner image is formed correspondingly to the target full color image.

The intermediate transfer drum 105, which is made of an elastic layer having a middle resistance and a surface layer having a high resistance on a metal drum, is driven to rotate in a clockwise direction as indicated by an arrow at almost the same circumferential speed as that of the photosensitive drum 101 in contact with the photosensitive drum 101 or in the vicinity thereof so as to transfer a toner image on the photosensitive drum 101 to the surface of the intermediate transfer drum 105 with a potential difference from the photosensitive drum 101 by giving a bias potential to the metal drum of the intermediate transfer drum 105.

The color toner image formed on the surface of the intermediate transfer drum 105 is transferred to a surface of a recording material P fed from a feeding portion which is not shown to a secondary transfer portion T2 at a predetermined timing in the secondary transfer portion T2 which is a contact nip portion between the intermediate transfer drum 105 and the transfer roller 106. The transfer roller 106 supplies electric charges having a polarity opposite to a polarity of toner from a back of the recording material P, by which the synthetic color toner image is gradually batch-transferred from the intermediate transfer drum 105 to the recording material P.

The recording material P which has passed the secondary transfer portion T2 is separated from the surface of the intermediate transfer drum 105 and introduced to a fixing apparatus (image heating apparatus) 100, where an unfixed toner image is subjected to heating and fixing processing and then the recording material P is discharged to a discharge (delivery) tray which is not shown outside the apparatus.

The intermediate transfer drum 105 after transferring the color toner image to the recording material P is cleaned by the cleaner 108 with removing adhering residue such as transfer residual toner or paper lint. This cleaner 108 is ordinarily held so as not to be in contact with the intermediate transfer drum 105 and to be in contact with the intermediate transfer drum 105 in the secondary transfer execution process of the color toner image from the intermediate transfer drum 105 to the recording material P.

The transfer roller 106 is also ordinarily held not to be in contact with the intermediate transfer drum 105 and to be in contact with the intermediate transfer drum 105 in the secondary transfer execution process of the color toner image from the intermediate transfer drum 105 to the recording material P via the recording material P.

This apparatus is capable of executing printing in a white and black image or other mono-color image print mode. In addition, printing in a double-sided print mode can be also executed.

In the double-sided print mode, the recording material P after first-side image printing output from the fixing apparatus 100 is reversed with upside down (a front surface and a rear surface) via a recycling conveying mechanism which is not shown, fed again to the secondary transfer portion T2 to be subjected to toner image transfer processing for the other surface, introduced to the fixing apparatus 100 again to be subjected to the toner image fixing processing for the other surface, and then a double-sided print is output.

Figure 2:
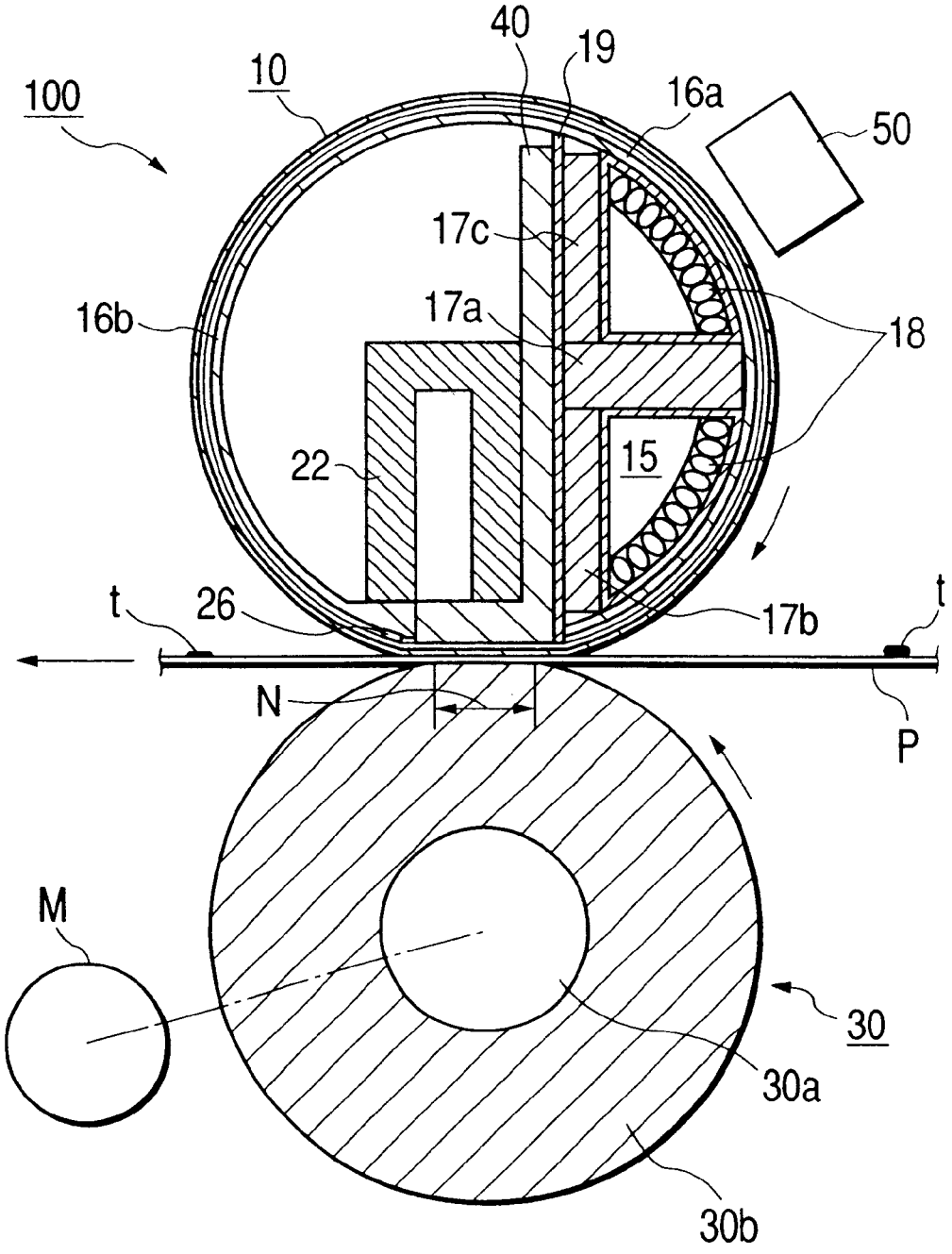
FIG. 2 is a sectional side elevation view of an image heating apparatus according to the embodiment.
Figure 3:
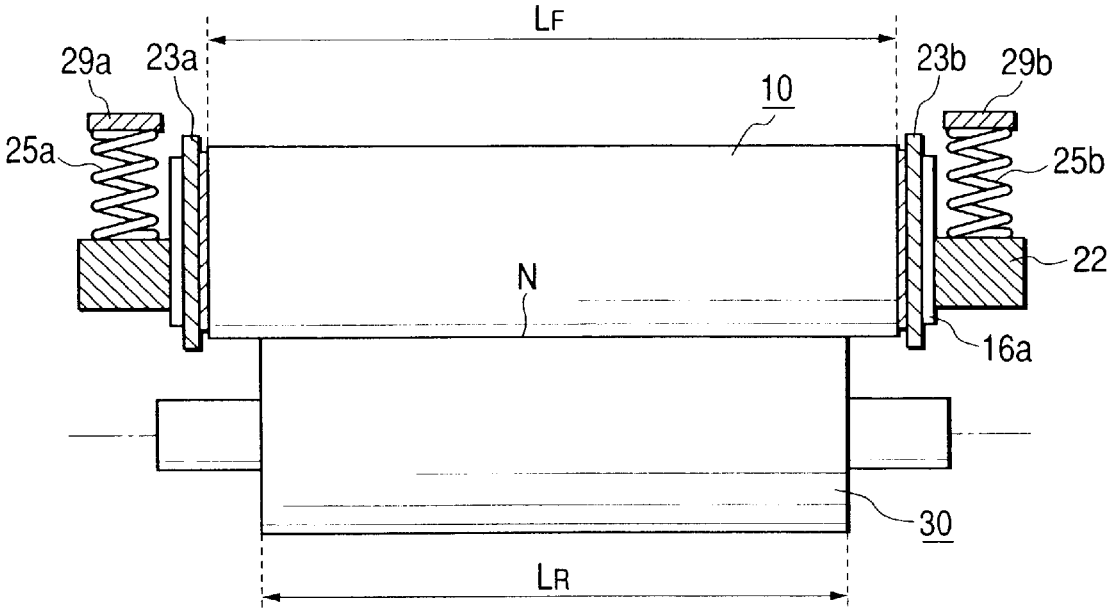
FIG. 3 is a front view of the image heating apparatus.
Figure 4:
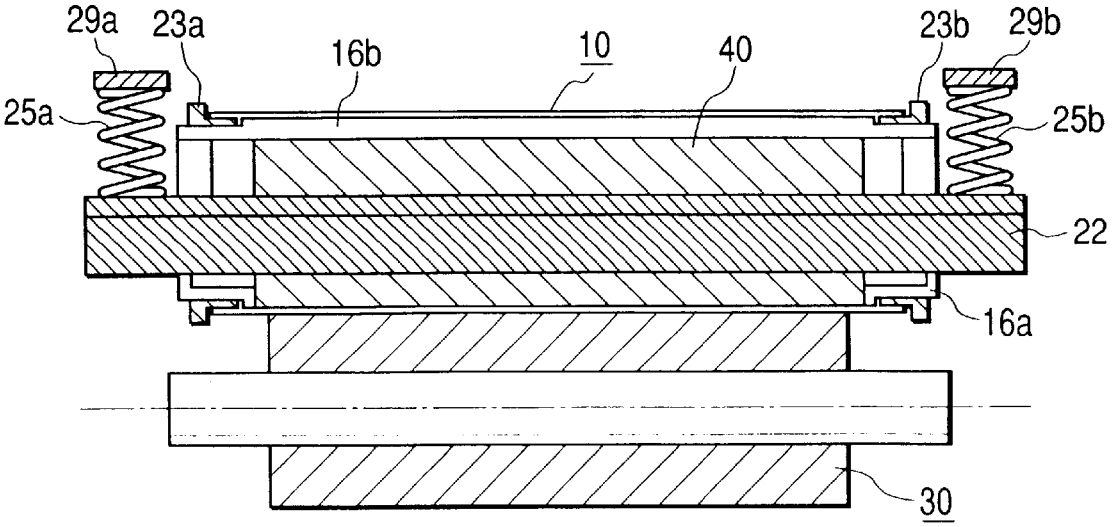
FIG. 4 is a front sectional view of the image heating apparatus.

In this embodiment, the fixing apparatus 100 is of an electromagnetic induction heating type. Referring to FIGS. 2, 3, and 4, there are shown a sectional side elevation pattern view of a main portion of the fixing apparatus 100 according to this embodiment, a front pattern view of the main portion, and a front sectional pattern view of the main portion, respectively.

Figure 19:
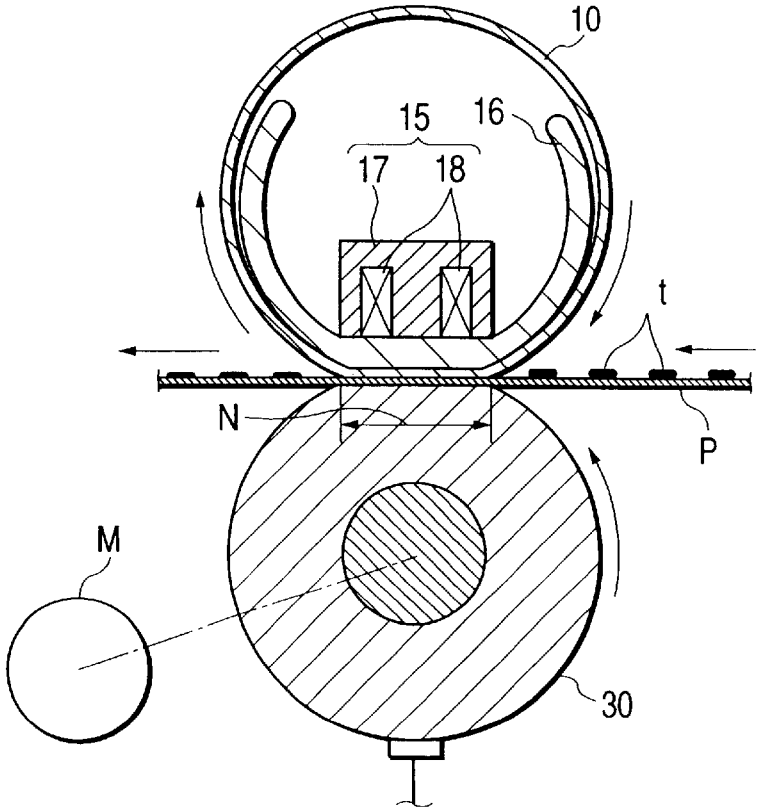
FIG. 19 is a diagram showing an example of an electromagnetic induction heating type image heating apparatus.

The apparatus 100 in this embodiment is of a pressurizing roller driving type and of an electromagnetic induction heating type with a cylindrical electromagnetic induction heating film in the same manner as for the fixing apparatus shown in FIG. 19. The same reference characters designate constituent members or parts common to the apparatus in FIG. 19 to omit their description.

Magnetic field generating means 15 comprises magnetic cores 17*a*, 17*b*, and 17*c* and an excitation coil 18.

The magnetic cores 17*a*, 17*b*, and 17*c*, which are members each having a high permeability, are preferably made of materials used for a core of a transformer such as ferrite or Permalloy, and further preferably ferrite whose loss is small even at 100 kHz or higher.

Figure 5:
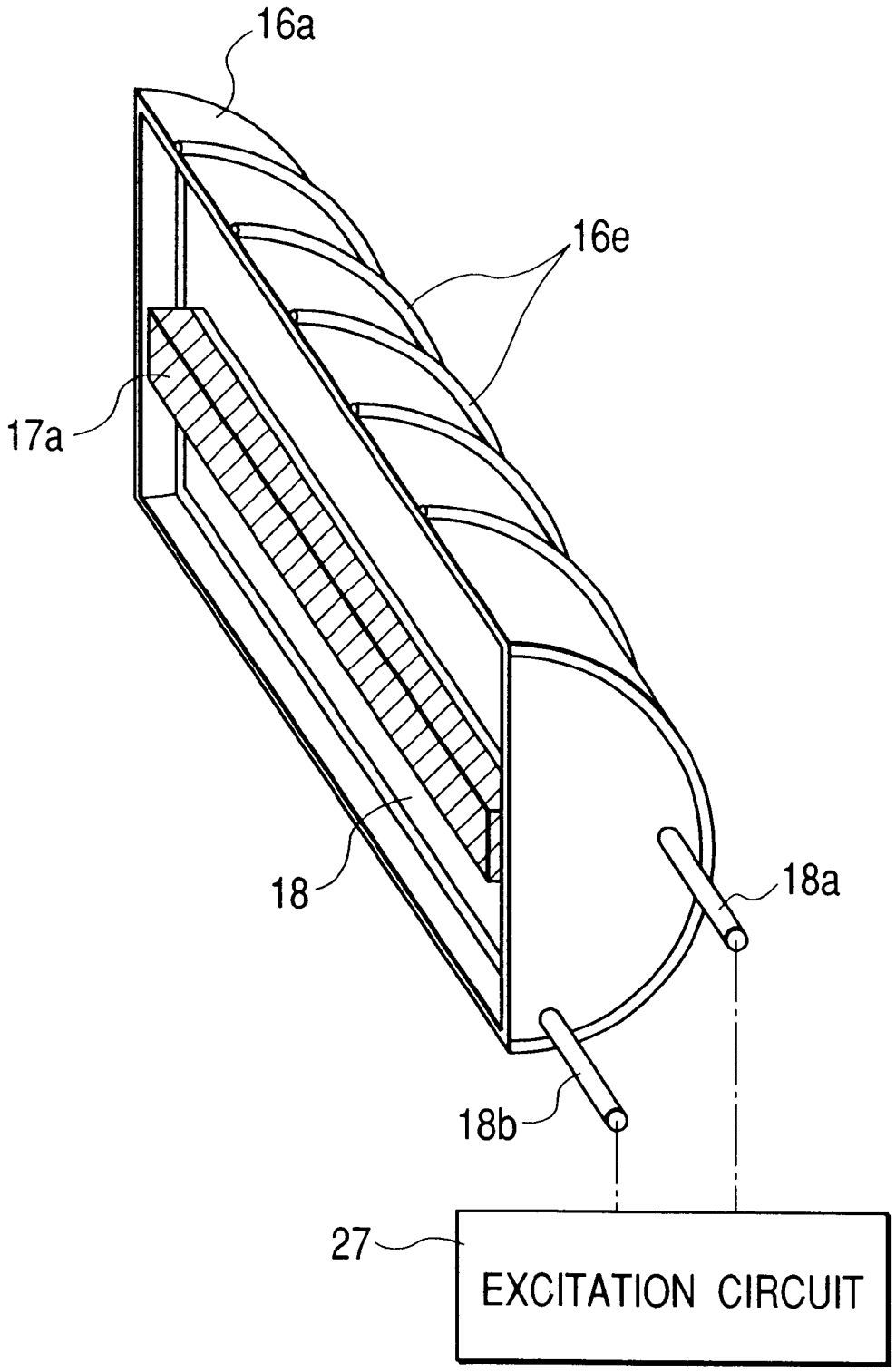
FIG. 5 is a perspective view of a film guide in which magnetic flux generating means are contained.

An excitation coil 18 is connected to an excitation circuit 27 at power supply portions 18*a* and 18*b* (FIG. 5). This excitation circuit 27 is configured to generate high frequencies of 20 kHz to 500 kHz by means of a switching power supply.

The excitation coil 18 generates alternating magnetic flux by means of alternating current (high-frequency current) supplied from the excitation circuit 27.

Film guide members 16*a* and 16*b* each having a cross-section almost semi-arc guttering shape form an almost cylindrical body with their opening portions opposed to each other and with a fixing film 10 which is a cylindrical electromagnetic induction heat generating film loosely fitted (coupled) to the body externally.

The film guide member 16*a* holds the magnetic cores 17*a*, 17*b*, and 17*c* as magnetic filed generating means 15 and the excitation coil 18 inside.

The film guide member 16*a* also contains a good heat conducting member 40 on an opposite side to a press roller 30 in the nip portion N in the inside of the fixing film 10.

In this example, aluminum is used for the good heat conducting member 40. The good heat conducting member 40 has a heat conductivity k of 240 [$w \cdot m^{-1} \cdot K^{-1}$] and a thickness of 1 [mm].

The good heat conducting member 40 is arranged in the outside of a magnetic field generated by the excitation coil 18 and the magnetic cores 17*a*, 17*b*, and 17*c* composing the magnetic field generating means 15 so as not to be affected by the magnetic field.

Specifically, the good heat conducting member 40 is arranged in one side of the magnetic cores 17*b* and 17*c* opposite to the excitation coil 18 to be located in the outside of the magnetic path generated by the excitation coil 18 to prevent the good heat conducting member 40 from being affected by the magnetic path.

An oblong pressurizing rigid stay 22 is arranged in contact with a rear side of a portion corresponding to the nip portion N of the good heat conducting member 40 and an inner plane portion of the film guide member 16*b*.

An insulating member 19 is used to insulate the magnetic cores 17*a*, 17*b*, and 17*c* and the excitation coil 18 from the pressurizing rigid stay 22.

Flange members 23*a* and 23*b* are externally coupled to horizontal both ends of an assembly of the film guide members 16*a* and 16*b* and mounted rotatably with the both ends fixed to regulate a slippage in a longer direction of the film guide member of the fixing film by receiving the end portions of the fixing film 10 when the fixing film 10 is rotating.

The pressurizing roller 30 as a pressurizing member comprises a core metal 30*a* and a heat resistant elastic layer 30*b* such as a silicone rubber, fluorine rubber, and fluorine resin coating the core metal so as to be molded in a shape of a roller concentrically and integrally, with the both ends of the core metal 30*a* rotatably borne between chassis side plates which are not shown in the apparatus.

A press-down force is applied to the pressurizing rigid stay 22 by arranging pressurizing springs 25*a* and 25*b* with being compressed between both ends of the pressurizing rigid stay 22 and spring bearing members 29*a* and 29*b* in the chassis side of the apparatus. With this application, a lower surface of a portion corresponding to the nip portion N of the good heat conducting member 40 and an upper surface of the pressurizing roller 30 pinches the fixing film 10 to be contacted with pressure, by which a fixing nip portion N having a predetermined width is formed.

The pressurizing roller 30 which is a driving member is driven rotatively in a counterclockwise direction indicated by an arrow by driving means M. The rotative driving of the pressurizing roller 30 applies a rotative force to the fixing film 10 with a frictional force between the pressurizing roller 30 and an external surface of the fixing film 10, by which the fixing film 10 rotates in an outer periphery of the film guide members 16*a* and 16*b* at a circumferential speed almost corresponding to that of the pressurizing roller 30 in a clockwise direction indicated by an arrow with sliding in contact with the lower surface of the good heat conducting member 40 where the fixing film 10 is a film supporting member in the fixing nip N in its inner surface.

Figure 20:
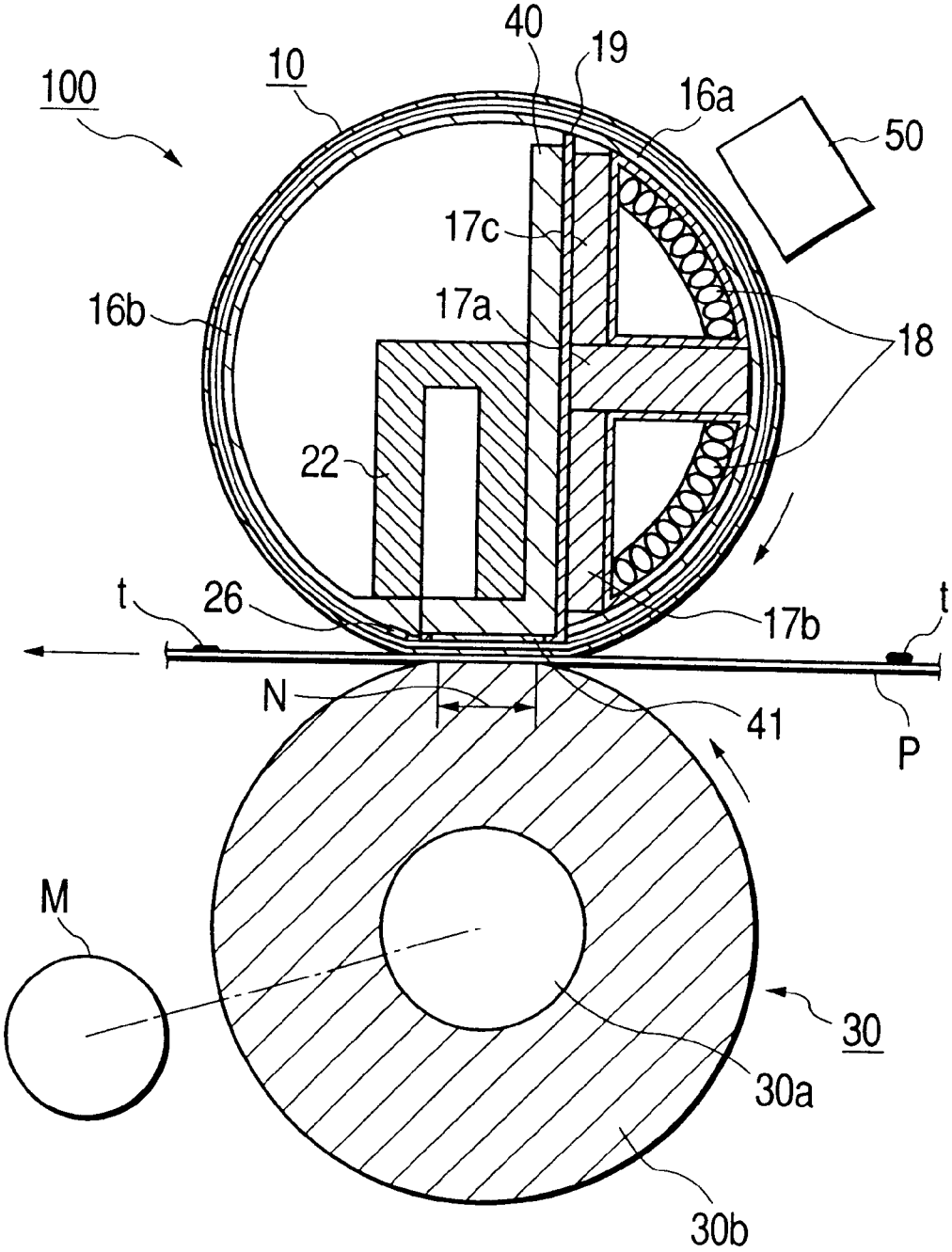
FIG. 20 is a sectional side elevation view of an image heating apparatus according to another embodiment.
Figure 21:
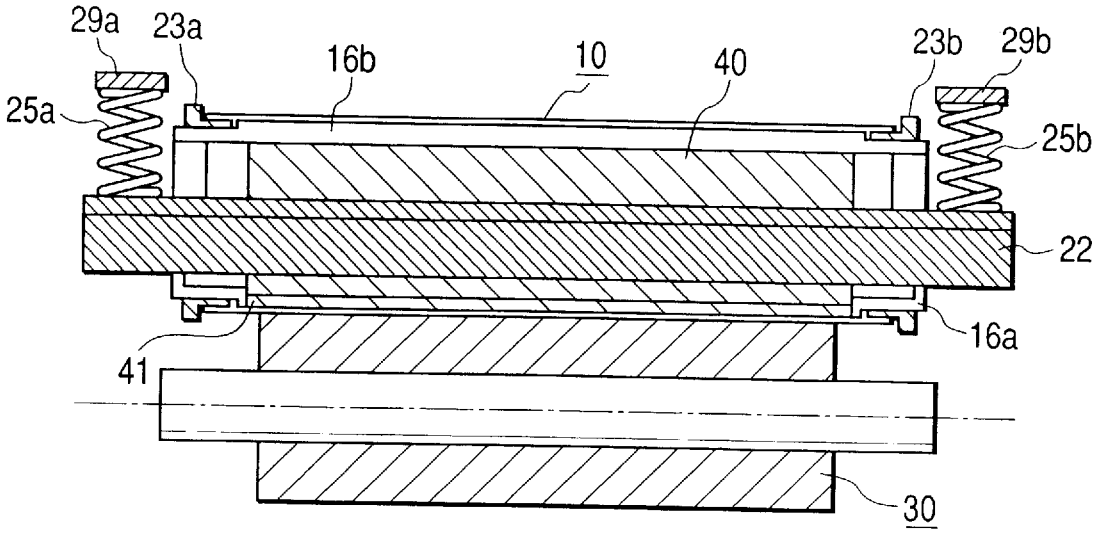
FIG. 21 is a front sectional view of the image heating apparatus in FIG. 20.

In this embodiment, lubricant such as heat-resistant grease is put between a lower surface of the good heat conducting member 40 of the fixing nip portion N and the inner surface of the fixing film 10 to reduce a mutual sliding frictional force between the lower surface of the good heat conducting member 40 and the inner surface of the fixing film 10 in the fixing nip portion N. In addition, as shown in FIGS. 20 and 21, the lower surface of the good heat conducting member 40 can be coated with a lubricating member 41 having a good slip property. It prevents the sliding fixing film 10 from being scratched with reducing its durability when material having a poor slip property such as aluminum is used for the good heat conducting member 40 or when a finishing process is simplified.

The good heat conducting member 40 has an effect of unifying a temperature distribution in a longer direction. If a small-sized sheet is passed, for example, an amount of heat on a no recording material passing portion in the fixing film 10 conducts to the good heat conducting member 40 and the amount of heat on the no recording material passing portion is conducted to the recording material passing portion on the small-sized sheet by heat conduction in the longer direction in the good heat conducting member 40. Accordingly, there can be also achieved an effect of reducing a power consumption when the small-sized sheet is passed.

As shown in FIG. 5, projecting rib portions 16*e* are formed at predetermined intervals in its longer direction on a circumferential surface of the film guide member 16*a* so as to reduce a contact sliding resistance between the circumferential surface of the film guide member 16*a* and the inner surface of the fixing film 10 to decrease a rotating load of the fixing film 10. This projecting rib portion 16*e* can also be formed on the film guide member 16*b* in the same manner.

Figure 6:
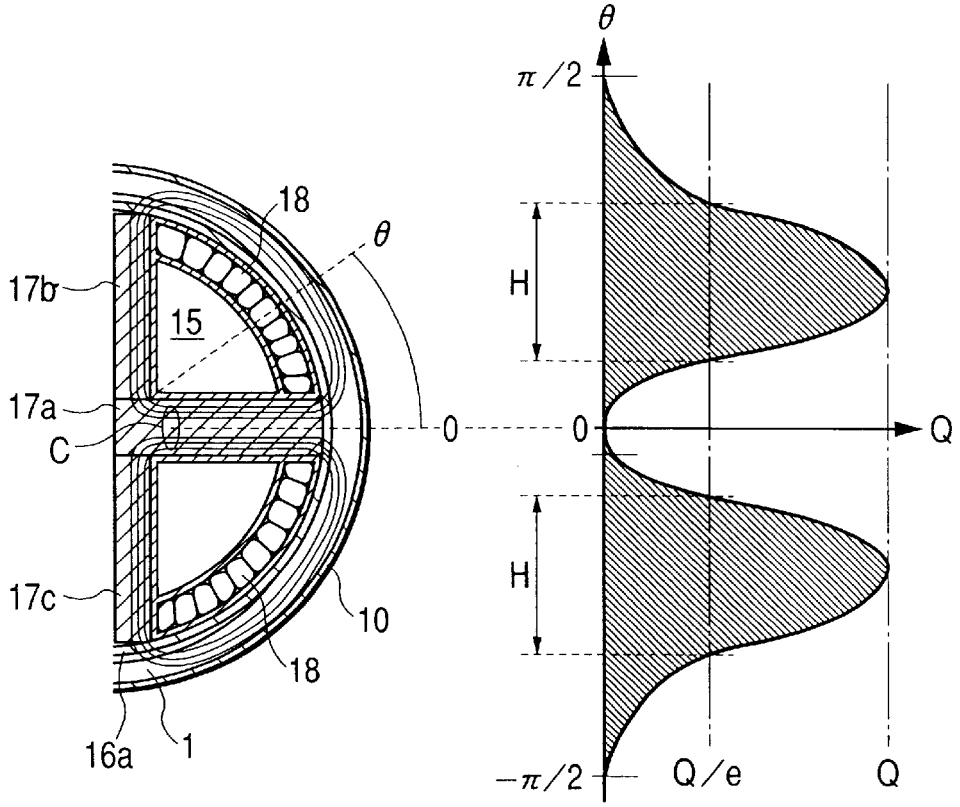
FIG. 6 is a diagram showing a relationship between the magnetic flux generating means and a heat generation amount.

Referring to FIG. 6, there is shown a condition of generating alternating magnetic flux. Magnetic flux C represents a part of the alternating magnetic flux which has been generated.

The alternating magnetic flux C guided by the magnetic cores 17*a*, 17*b*, and 17*c* generates eddy-current in the electromagnetic induction heat generating layer 1 of the fixing film 10 between the magnetic core 17*a* and the magnetic core 17*b* and between the magnetic core 17*a* and the magnetic core 17*c*. This eddy-current generates Joule heat (eddy-current loss) in the electromagnetic induction heat generating layer 1 by a specific resistance thereof.

A quantity of generated heat Q depends upon a density of magnetic flux passing the electromagnetic induction heat generating layer 1, having a distribution as shown in a graph in FIG. 6. In the graph of FIG. 6, an ordinate axis indicates a position in a circumferential direction in the fixing film 10 represented by an angle θ with a center of the magnetic core 17*a* as zero (0) and an abscissa axis indicates a quantity of generated heat Q of the fixing film 10 in the electromagnetic induction heat generating layer 1. If the heat generated region H is defined to be a region of Q/e or greater quantity of generated heat, where Q is the maximum quantity of generated heat. It is a region in which a quantity of generated heat required for fixing is obtained.

A temperature of the fixing nip portion N is adjusted so as to maintain a predetermined temperature by controlling a power supply to the excitation coil 18 by means of a temperature control system including temperature detecting means 26 (FIG. 2).

The temperature detecting means 26 is a temperature sensor such as a thermistor for detecting a temperature of the fixing film 10. In this embodiment, a temperature of the fixing nip portion N is controlled on the basis of temperature information of the fixing film 10 measured by the temperature sensor 26.

In a condition that the fixing film 10 rotates by which electromagnetic induction heat is generated on the fixing film 10 as described in the above by a power supply from the excitation circuit 27 to the excitation coil 18 and the fixing nip portion N is risen to a predetermined temperature for a temperature control in this manner, a recording material P on which an unfixed toner image t conveyed from the image forming means is inserted between the fixing film 10 and the pressurizing roller 30 in the fixing nip portion N with its image surface directed upward, in other words, opposite to a fixing film surface and then pinched and conveyed in the fixing nip portion N together with the fixing film 10 with its image surface put in contact with the outer surface of the fixing film 10 in the fixing nip portion N.

In this process of pinching and conveying the recording material P together with the fixing film 10 in the fixing nip portion N, the unfixed toner image t on the recording material P is heated and fixed by the electromagnetic induction heat generation on the fixing film 10.

After passing through the fixing nip portion N, the recording material P separates from the outer surface of the fixing film 10 and conveyed to be discharged.

A heated and fixed toner image on the recording material P is cooled to be a permanent fixed image after passing through the fixing nip portion.

In this embodiment, as shown in FIG. 2, a thermo-switch 50 which is a temperature detecting element is arranged to turn off the power supply to the excitation coil 18 at runaway in an opposite position to the heat generated region H (FIG. 6) of the fixing film 10.

Figure 7:
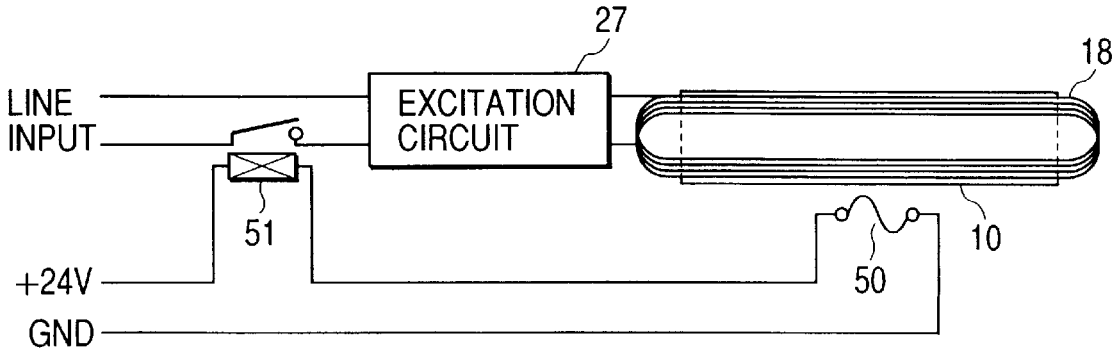
FIG. 7 is a diagram showing a safety circuit.

Referring to FIG. 7, there is shown a circuit diagram of a safety circuit used in this embodiment. The thermo-switch 50 which is a temperature detecting element is connected to a DC power supply of 24 V and a relay switch 51 in series; if the thermo-switch 50 is turned off, the power supply to the relay switch 51 is immediately turned off, the relay switch 51 operates, and a power supply to the excitation circuit 27 is immediately turned off, by which a power supply to the excitation coil 18 is turned off. An OFF operating temperature of the thermo-switch 50 is set to 220° C.

The thermo-switch 50 is arranged not to be in contact with the outer surface of the fixing film 10 so as to be opposed to the heat generated region H of the fixing film 10. A distance between the thermo-switch 50 and the fixing film 18 is determined to be about 2 mm. This prevents the fixing film 10 from being scratched by a contact with the thermo-switch 50 so as not to deteriorate a fixed image with durability.

According to this embodiment, at runaway of the fixing apparatus due to a trouble thereof, unlike a configuration in which heat is generated in the nip portion N as shown in FIG. 19, heat is not generated in the nip portion N where a sheet is pinched and therefore the sheet is not heated directly even if the fixing apparatus stops in a condition that a sheet is pinched in the fixing nip N and the fixing film 10 continues to generate heat with the excitation coil 18 continued to be powered. In addition, the thermo-switch 50 is arranged in the heat generated region H where a large quantity of heat is generated, and therefore the thermo-switch 50 detects the temperature of 220° C. and powered off, when a power supply to the excitation coil 18 is immediately turned off by the relay switch 51.

According to this embodiment, an ignition temperature of a sheet is about 400° C. and therefore it does not ignite, by which heat generation of the fixing film 10 can be stopped.

A temperature fuse can be used as a temperature detecting element in addition to the thermo-switch 50.

While toner made of toner t including low softening point material is used and therefore no oil coating mechanism for preventing an offset is arranged in the fixing apparatus in this embodiment, an oil coating mechanism can be arranged if toner not including the low softening point material is used. In addition, oil coating or cooling separation can be performed also when using toner including the low softening point material.

Bundled small-gage wires made of copper each insulated with coating (bundled wires) are used as conductor wires (electrical wires) composing a coil (wire ring) for the excitation coil 18 and they are wound by a plurality of turns to form an excitation coil. In this embodiment, they are wound by ten turns to form the excitation coil 18.

For the insulating coating, coating having a heat resistance is preferably used taking into consideration a heat conductivity caused by the heat generation of the fixing film 10. For example, it is preferable to use coating such as amide-imide or polyimide.

A pressure can be applied to the excitation coil 18 from the outside to improve its density.

A shape of the excitation coil 18 is configured to outline a curved surface of the heat generating layer of the fixing film 10 as shown in FIG. 2. In this embodiment, a distance between the heat generating layer 1 of the fixing film 10 and the excitation coil 18 is set to be about 2 mm.

As material of the film guide members (excitation coil holding members) 16*a* and 16*b*, it is preferable to use material having superior insulating characteristics and heat resistance. For example, phenolic resin, fluorine resin, polyimide resin, polyamide resin, polyamide-imide resin, PEEK resin, PES resin, PPS resin, PFA resin, PTFE resin, FEP resin, LCP resin or the like is preferably used.

While an absorption efficiency of magnetic flux is increased by narrowing a distance between the magnetic cores 17*a*, 17*b*, and 17*c* and the excitation coil 18 and the heat generating layer 1 of the fixing film 10 if possible, this efficiency is significantly decreased when the distance exceeds 5 mm and therefore it is preferable to restrain the distance to 5 mm or shorter. If it is 5 mm or shorter, the distance between the heat generating layer 1 of the fixing film 10 and the excitation coil need not be fixed.

As for a lead-out wire from the film guide member 16*a* for the excitation coil 18, in other words, power supply portions

18*a* and 18*b* (FIG. 5), the bundled wires are externally insulated with coating in portions in the outside of the film guide member 16*a*.

Figure 8:
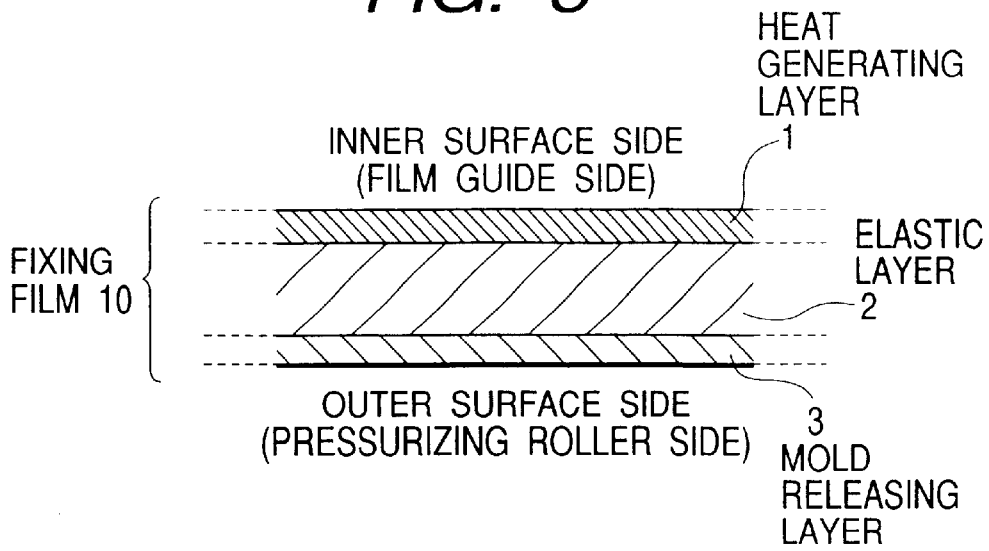
FIG. 8 is a diagram showing a configuration of film layers.

Referring to FIG. 8, there is shown a layer configuration typical diagram of the fixing film 10 in this embodiment. The fixing film 10 in this embodiment has a complex configuration formed by a heat generating layer 1 made of a metal film or the like which is a base layer of the fixing film 10 having an electromagnetic induction heat generating property, an elastic layer 2 laid on its outer surface, and a mold releasing layer 3 laid on its outer surface.

In order to bond the heat generating layer 1 to the elastic layer 2 and the elastic layer 2 to the mold releasing layer 3, a primer layer (not shown) can be arranged between respective layers.

In the fixing film 10 having an almost cylindrical shape, the heat generating layer 1 is put in an inner surface side and the mold releasing layer 3 is put in an outer surface side. As described above, eddy-current is generated in the heat generating layer 1 by an action of the alternating magnetic flux on the heat generating layer 1, by which the heat generating layer 1 generates heat. A recording material P as a heated material passed through the fixing nip N is heated by the heat via the elastic layer 2 and the mold releasing layer 3, so that a toner image is fixed by heat.

For the heat generating layer 1, ferromagnetic metal such as nickel, iron, ferromagnetic SUS, or nickel-cobalt alloy is preferably used.

Although non-magnetic metal can also be used, metal having a superior magnetic flux absorption property such as nickel, iron, magnetic stainless, or cobalt-nickel alloy is more preferable.

Its thickness is preferably greater than a depth of a skin expressed by the following formula and less than or equal to 200 $\mu$m:

$$\sigma=503\times(\rho/f\mu)^{1/2}$$

where $\sigma$[mm] is the depth of the skin with a frequency f [Hz] of the excitation circuit 27, permeability $\mu$, and a specific resistance $\rho$[$\Omega$m].

Figure 9:
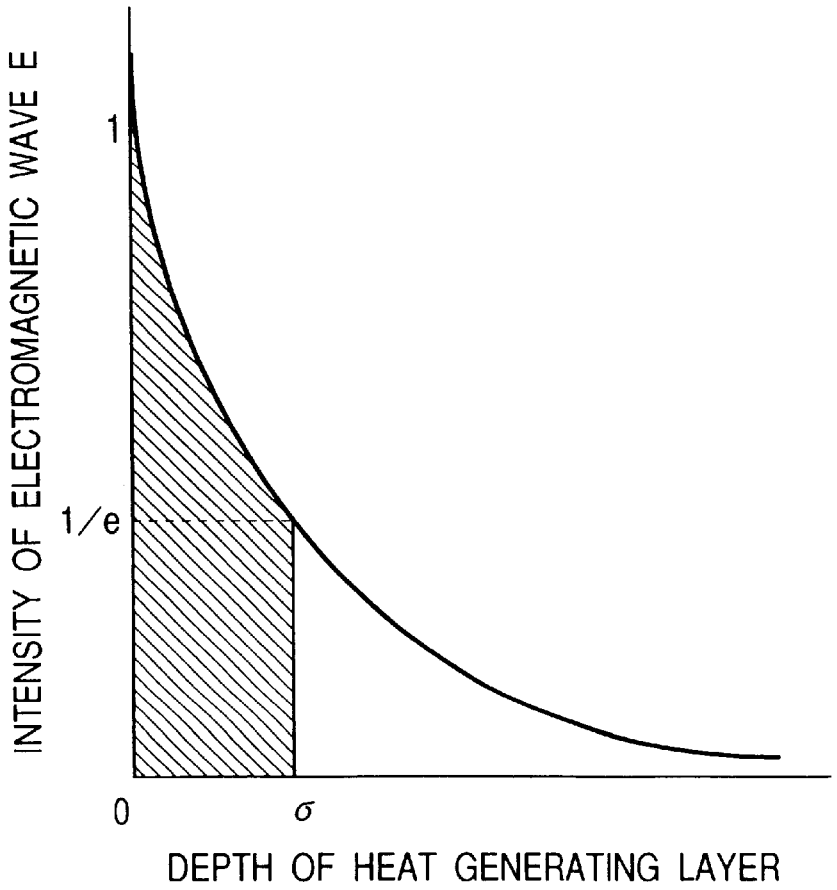
FIG. 9 is a graph showing a relationship between a depth of a heat generating layer and an intensity of an electromagnetic wave.

This represents a depth of an absorption of electromagnetic waves used for the electromagnetic induction. In portions having a depth greater than this, an intensity of the electromagnetic waves is less than or equal to 1/e. Conversely, almost all the energy is absorbed up to this depth (FIG. 9).

The depth of the heat generating layer 1 is preferably 1 to 100 $\mu$m. If the thickness of the heat generating layer 1 is smaller than 1 $\mu$m, almost all the electromagnetic energy cannot be absorbed, thereby its efficiency is deteriorated. If the depth of the heat generating layer 1 exceeds 100 $\mu$m, rigidity is too high and a flexing property is deteriorated and therefore it is not practical to use it as a rotator. Accordingly, the thickness of the heat generating layer 1 is preferably 1 to 100 $\mu$m.

The elastic layer 2 is made of material such as silicone rubber, fluorine rubber, or fluoro-silicone rubber having a superior heat-resistance and heat conductivity.

The thickness of the elastic layer 2 is preferably 10 to 500 $\mu$m. This thickness of the elastic layer 2 is necessary to ensure a fixing image quality.

In printing a color image, particularly a photographic image, a solid image is formed in a large area on the recording material P. In this condition, unevenness of a heat generation occurs unless a heating surface (the mold releasing layer 3) can follow an uneven surface of a recording material or of a toner layer, by which an uneven gloss occurs on an image in portions having a large quantity of conducted heat and a small quantity thereof. The portions having a large quantity of conducted heat has a high gloss value and those having a small quantity of conducted heat has a low gloss value.

The elastic layer 2 having a thickness less than or equal to 10 $\mu$m cannot completely follow unevenness of the recording material or the toner layer, thereby causing uneven gloss on an image. If the elastic layer 2 has a thickness of more than or equal to 1000 $\mu$m, a heat resistance of the elastic layer becomes large, by which it is hard to perform a quick start. More preferably, the thickness of the elastic layer 2 is 50 to 500 $\mu$m.

If a hardness of the elastic layer 2 is too high, the elastic layer 2 cannot completely follow the unevenness of the recording material or the toner layer, thereby causing an uneven gloss of the image. Therefore, a hardness of the elastic layer 2 is preferably 60° (JIS-A, i.e., a hardness determined by a JIS-K6301 A-type hardness tester) or lower, more preferably 45° or lower.

A heat conductivity $\lambda$ of the elastic layer 2 is preferably as follows:

$6\times10^{-4}$ [cal/cm·sec·deg.]($6\times10^{-4}\times4.186\cong25.1\times10^{-4}$ [J/cm·sec·deg.]) to $2\times10^{-3}$ [cal/cm·sec·deg.]($2\times10^{-3}\times4.186\cong8.4\times10^{-3}$ [J/cm·sec·deg.])

If the heat conductivity $\lambda$ is less than $6\times10^{-4}$ [cal/cm·sec·deg.]($6\times10^{-4}\times4.186\cong25.1\times10^{-4}$ [J/cm·sec·deg.]) to $2\times10^{-3}$ [cal/cm·sec·deg.]($2\times10^{-3}\times4.186\cong8.4\times10^{-3}$ [J/cm·sec·deg.]), a heat resistance is large and a temperature on a surface layer (the mold releasing layer 3) of the fixing film increases more slowly.

If the heat conductivity $\lambda$ is more than $2\times10^{-3}$ [cal/cm·sec·deg.]($2\times10^{-3}\times4.186\cong8.4\times10^{-3}$ [J/cm·sec·deg.]), the hardness becomes too high or a permanent compression set is deteriorated.

Accordingly, it is preferable that the heat conductivity $\lambda$ is within the range of $6\times10^{-4}$ [cal/cm·sec·deg.]($6\times10^{-4}\times4.186\cong25.1\times10^{-4}$ [J/cm·sec·deg.]) to $2\times10^{-3}$ [cal/cm·sec·deg.]($2\times10^{-3}\times4.186\cong8.4\times10^{-3}$ [J/cm·sec·deg.]). More preferably, it is within a range of $8\times10^{-4}$ [cal/cm·sec·deg.]($8\times10^{-4}\times4.186\cong33.5\times10^{-4}$ [J/cm·sec·deg.]) to $1.5\times10^{-3}$ [cal/cm·sec·deg.]($1.5\times10^{-3}\times4.186\cong6.3\times10^{-3}$ [J/cm·sec·deg.]).

For the mold releasing layer 3, it is possible to select any of fluorine resin, silicone resin, fluoro-silicone rubber, fluorine rubber, silicone rubber, PFA, PTFE, FEP or other material having superior releasing property and heat resistance.

A thickness of the mold releasing layer 3 is 1 to 100 $\mu$m. If the thickness of the mold releasing layer 3 is less than 1 $\mu$m, there occurs a problem that an uneven film of coating makes portions having a poor releasing property or that a durability is insufficient. Furthermore, if the mold releasing layer 3 exceeds 100 $\mu$m, it causes a problem that the heat conductivity is deteriorated and, particularly for a resin mold releasing layer, the hardness becomes too high, which reduces an effect of the elastic layer 2.

Figure 10:
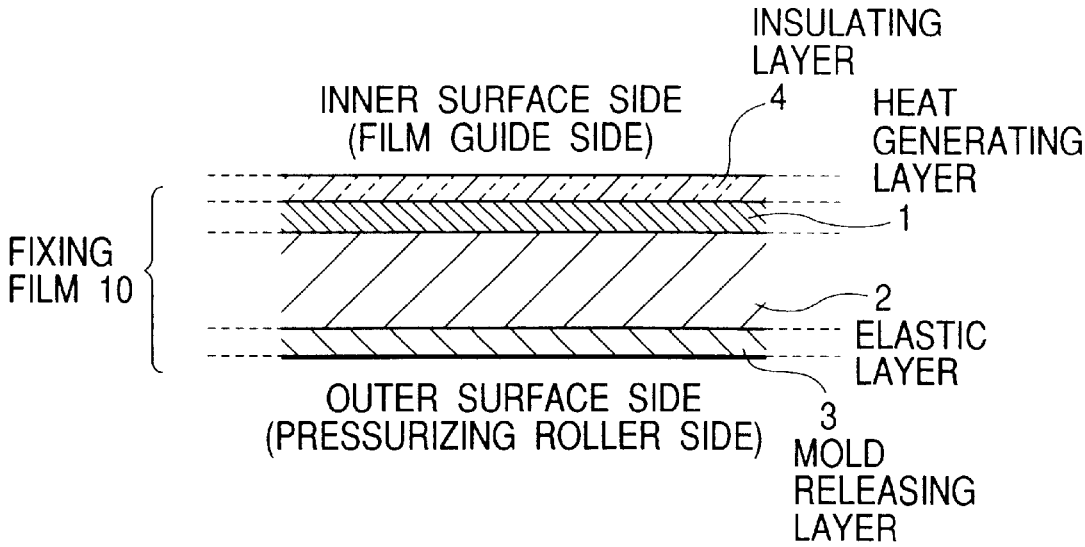
FIG. 10 is a diagram showing a configuration of other film layers.

As shown in FIG. 10, in the configuration of the fixing film 10, an insulating layer 4 can be arranged in the film guide member side (in the opposite side to the elastic layer 2 of the heat generating layer 1) of the heat generating layer 1.

For the insulating layer 4, it is preferable to use heat-resistant resin such as fluorine resin, polyimide resin, polyamide resin, polyamide-imide resin, PEEK resin, PES resin, PPS resin, PFA resin, PTFE resin, or FEP resin.

A thickness of the insulating layer 4 is preferably 10 to 1000 μm. If the thickness of the insulating layer 4 is less than 10 μm, a thermal insulating effect cannot be obtained and durability is insufficient. On the other hand, if the thickness exceeds 1000 μm, a distance from the magnetic cores 17*a*, 17*b*, and 17*c* and the excitation coil 18 to the heat generating layer 1 is too long, by which the magnetic flux is not sufficiently absorbed by the heat generating layer 1.

The insulating layer 4 works as a thermal barrier in such a way that heat generated in the heat generating layer 1 does not move to the inside of the fixing film 10, and therefore an efficiency of supplying heat to the recording material P side is improved in comparison with a condition in which the insulating layer 4 is not arranged. Accordingly, a power consumption can be restrained.

A nip width of a fixing device in the full-color image forming apparatus is preferably at least 7.0 mm to ensure a sufficient fixing property of a full-color image having a relatively large amount of stacked toner. If the width is less than 7.0 mm, a sufficient quantity of heat cannot be given to unfixed toner and a recording material, thereby causing a fixing failure.

Furthermore, to ensure a transmission property of an OHT full-color image sufficiently, a surface pressure of the nip portion is preferably 0.8 kgf/cm$^2$ or greater. If it is less than 0.8 kgf/cm$^2$, a surface of the fixed toner layer cannot be smoothed enough, and therefore irregular reflected lights are increased, thus reducing a transmitted light volume of the OHT image portion.

From this viewpoint, in the fixing apparatus in this embodiment, the pressurizing roller 30 and the fixing film 10 are pressed with a force of 21 kgf with a nip width of approx. 8.0 mm and a surface pressure in the nip portion of 1.2 kgf/cm$^2$ (a length 220 mm in the longer direction of the nip portion).

Next, an explanation will be made for a rotative driving control at rising of the fixing apparatus which is a characteristic of the present invention.

If the image forming apparatus is put in a standby condition, the fixing apparatus 100 is in a resting condition. The fixing apparatus 100 in this embodiment is of on-demand type, and therefore the fixing apparatus 100 is not powered in the standby condition.

If a print signal is inputted to the image forming apparatus body, a driving force is transmitted from a driving motor of the image forming apparatus body to the fixing apparatus 100 via gears. Then the fixing film 10 rotates in the outer periphery of the film guide members 16*a* and 16*b* while sliding over the lower surface of the good heat conducting member 40 in the nip portion. Afterward, a power is supplied to the excitation circuit 27 of the fixing apparatus 100, the fixing film 10 is risen in temperature by an induction heat generation, and the fixing apparatus 100 transits to a fixable condition.

Although this specification of the present invention prescribes a control of a rotational speed of the film rotator 10 at a start of rotative driving, the fixing film 10 which is a film rotator rotates following the pressurizing roller 30 at a circumferential speed almost corresponding to the circumferential speed of the pressurizing roller 30. Accordingly, in this embodiment, a description is made for a speed control of the pressurizing roller 30 in which driving is transmitted from the driving motor practically.

At a start of this fixing apparatus, a working torque necessary for rotating it from a resting condition can be classified into "an acceleration torque" and "a load torque".

The former "acceleration torque" depends upon an acceleration from a resting condition to a process speed. By moderating a change of a driving speed of the pressurizing roller 30 immediately after the start of the rotative driving, in other words, by slowing it up, the acceleration torque can be reduced. In addition, if the driving speed is low, a viscosity torque is also reduced, and therefore it leads to a reduction of the load torque described later.

The latter "load torque" depends upon a frictional load and an external load of a driven apparatus. Particularly immediately after a start of driving the fixing apparatus, a static frictional force greater than a dynamic frictional force is generated, and therefore the load torque is greater than that during a driving operation. In this embodiment, the load torque significantly changes due to a viscosity of heat-resistant grease as lubricant between the fixing film 10, the guide members 16*a* and 16*b* as its supporting members, and the good heat conducting member 40. Particularly, at a start of the fixing apparatus in a condition that it is cooled down to a room temperature, the viscosity of the heat-resistant grease is high and a viscosity load is large.

Therefore, in the present invention, a slow-up rotative driving is performed to reduce the above "acceleration torque" and a temperature of the fixing apparatus is risen during the rotative driving, by which the viscosity of the heat-resistant grease which is lubricant is lowered to reduce the load torque together with it.

Figure 11:
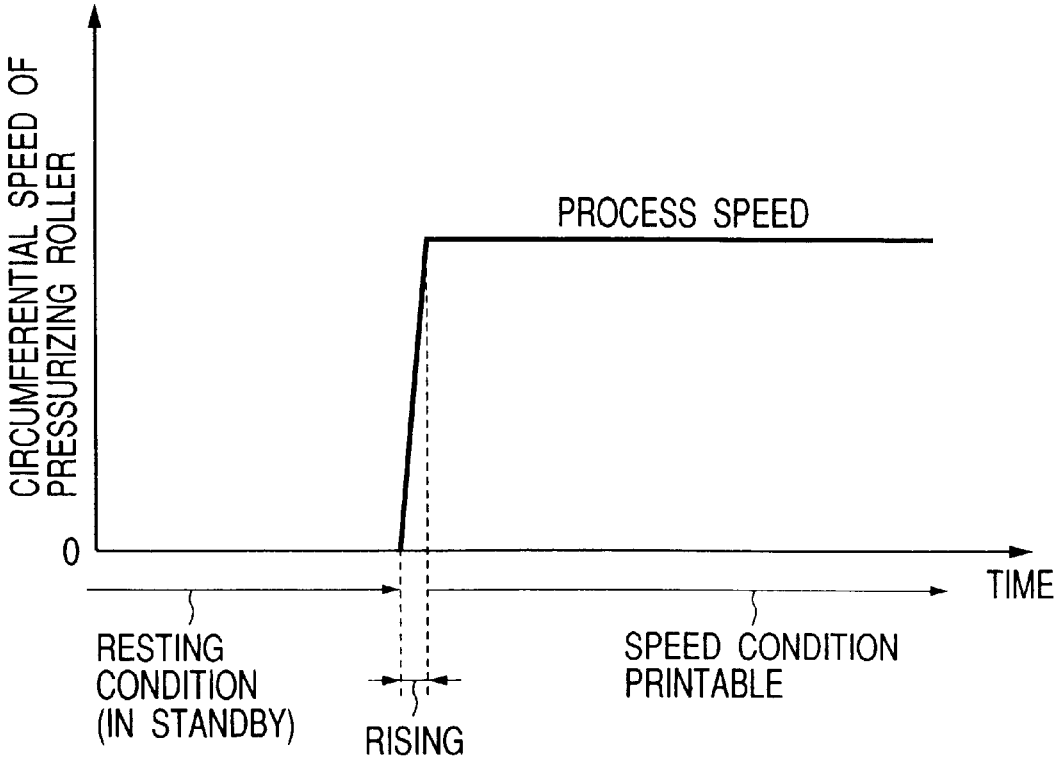
FIG. 11 is a diagram showing a driving control pattern of a conventional pressurizing roller.

Referring to FIG. 11, there is shown a conceptional diagram showing a change of a circumferential speed of the pressurizing roller at a start of rotative driving in a conventional fixing apparatus driving control. The abscissa axis indicates an elapsed time and an ordinate axis indicates a rotational speed of the pressurizing roller. As shown in FIG. 11, conventionally the pressurizing roller is generally driven at a predetermined process speed which is a constant speed from a moment at which a driving force is transmitted to the fixing apparatus in the resting condition. Normally, an acceleration time from the resting condition to a predetermined process speed is about 0.1 sec. Therefore, as well as a large acceleration torque, the pressurizing roller and the fixing film rotate at a predetermined process speed in a condition that the fixing film is not warmed up enough at the first run (start) in the morning, and therefore the viscosity of the heat-resistant grease is high and a very large torque is required at the start.

Figure 12:
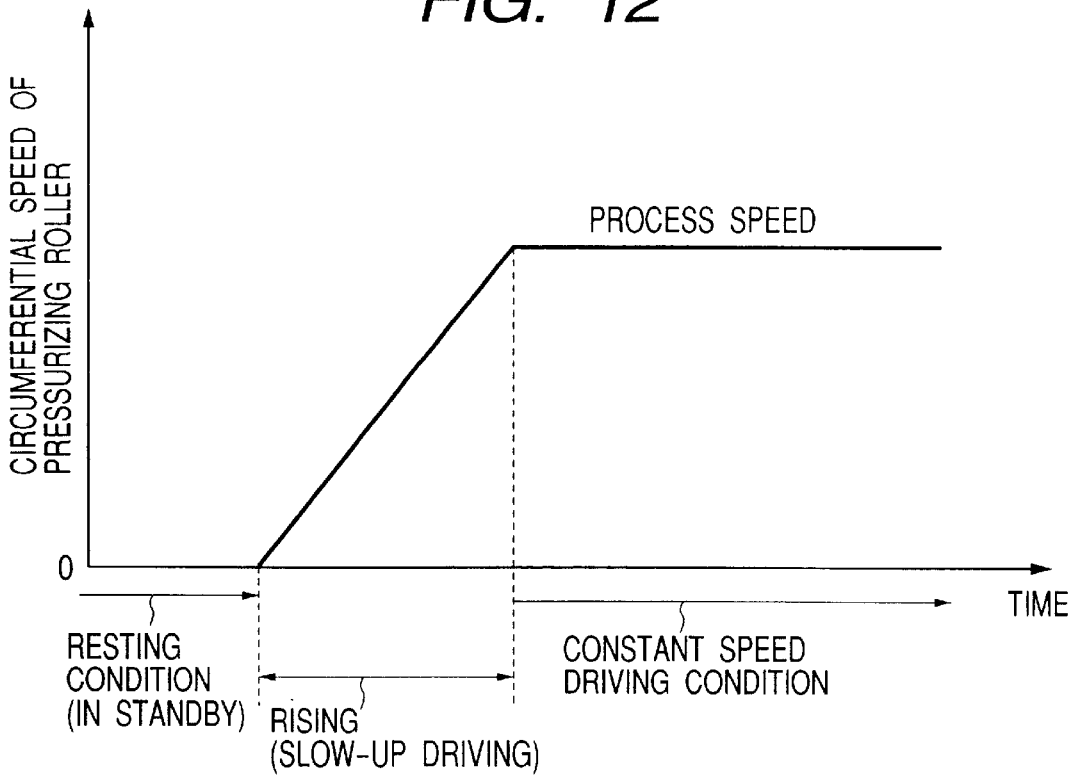
FIG. 12 is a diagram showing a driving control pattern of a pressurizing roller according to the embodiment.
Figure 13:
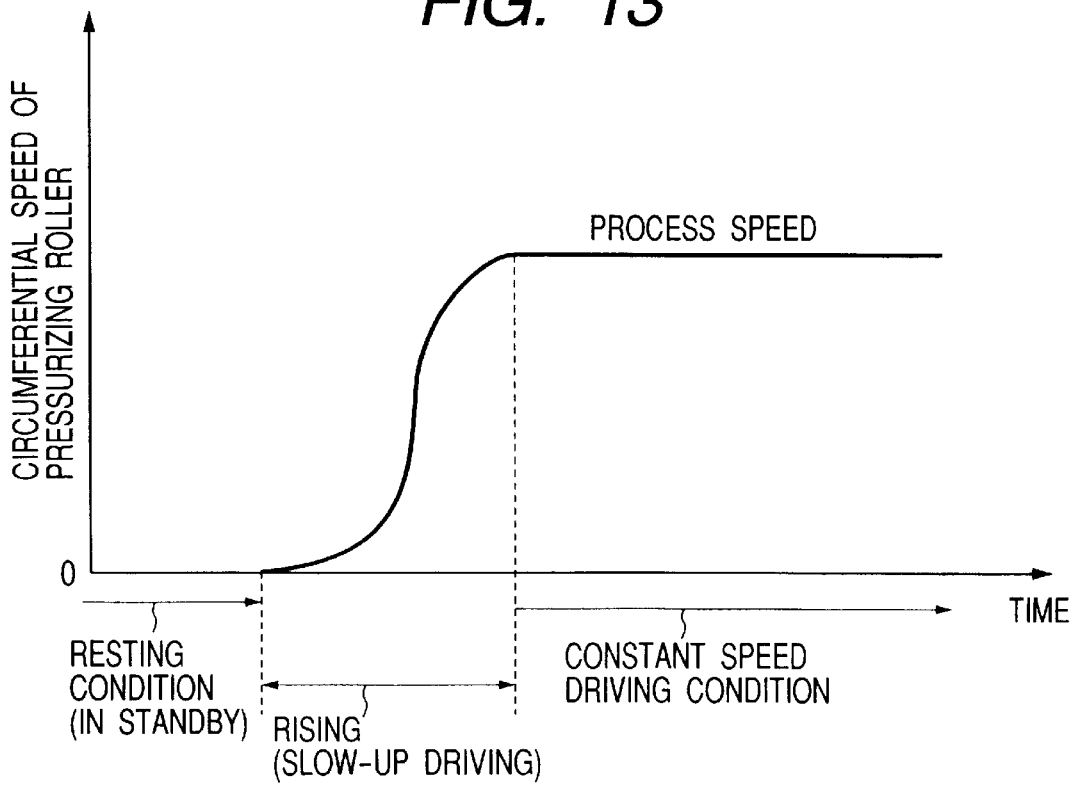
FIG. 13 is a diagram showing a driving control pattern of a pressurizing roller according to another embodiment.
Figure 14:
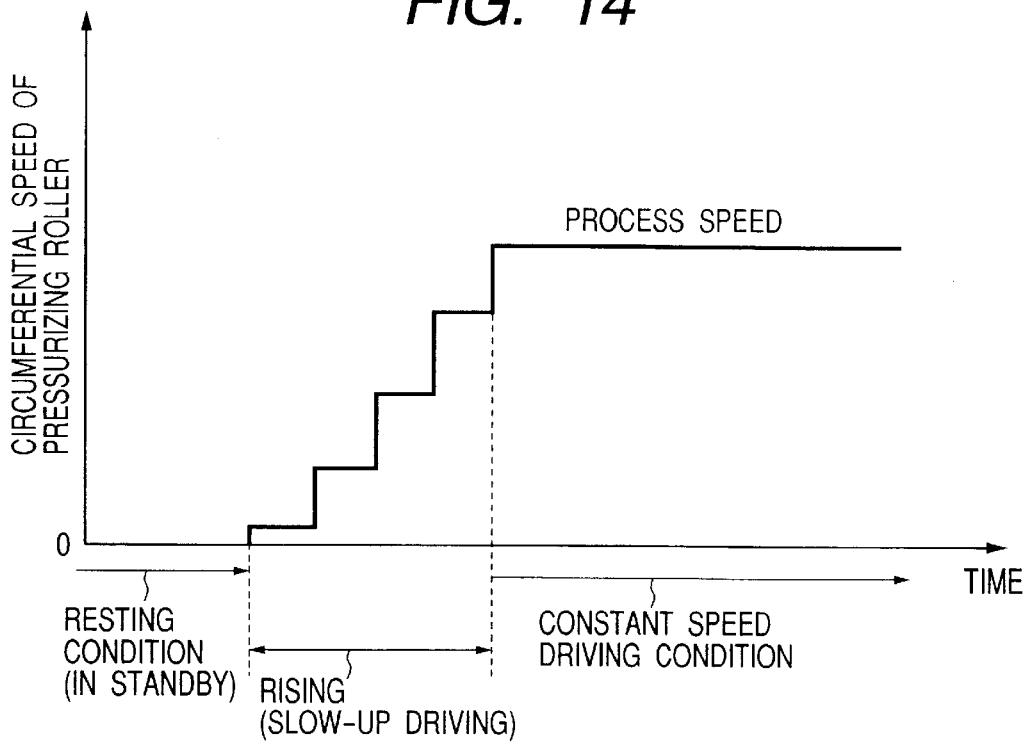
FIG. 14 is a diagram showing a driving control pattern of a pressurizing roller according to still another embodiment.

Referring to FIGS. 12 to 14, there are shown conceptional diagrams showing changes of the circumferential speed of the pressurizing roller at the start of the rotative driving under the driving control of the fixing apparatus according to the present invention.

As shown in FIG. 12, at a moment when the driving force is transmitted to the pressurizing roller, the pressurizing roller is driven at a very low speed (a first speed) and the circumferential speed is linearly slowed up gradually taking time so as to reach a predetermined process speed (a second speed) finally. The time required for the slow-up driving is set to an optimum value according to the fixing apparatus. Unlike rising in the conventional driving, however, it is not performed in a short time such as approx. 0.1 sec.

Strictly speaking, if the driving roller (pressurizing roller) is risen from "0" to a certain speed, a low-speed region (acceleration region) for a very short time is inevitably generated, while the first speed region in the present invention does not include this low-speed region, but the first speed region is controlled so that the low-speed period is elongated by being set on the basis of the necessarily generated speed at rising.

Time required for the slow-up driving is set to a period between an input of a print signal and an entry into the fixing nip of the recording material on which an image is formed, and the acceleration torque at the start of the rotative driving must be sufficiently reduced by the setting.

This slow-up driving can be controlled to be a nonlinear driving in such a way that a circumferential speed is increased at a very small acceleration immediately after the start of the driving before the acceleration is gradually increased as shown in FIG. 13.

In addition, as shown in FIG. 14, the slow-up driving can be controlled in such a way that the circumferential speed is increased in steps with dividing the circumferential speed into several grades as shown in FIG. 14. In this case, the first speed includes a speed region in which the speed is constant for a predetermined time.

Furthermore, the control patterns of the above three slow-up driving can be combined with each other.

Any of the above driving control patterns is characterized by the circumferential speed immediately after the start of the driving of the pressurizing roller set to be lower than the process speed (fixing speed).

Accordingly, the present invention prevents a step-out of the driving motor.

In addition, a power supply to the fixing apparatus (a power supply to the excitation circuit 27) is started simultaneously with the start of the slow-up driving or during the slow-up driving. This heats the heat-resistant grease between the inner surface of the fixing film and its supporting member, by which the viscosity is lowered and the load torque is reduced. Particularly in the electromagnetic induction heat generating method as in this fixing apparatus, the heat-up speed is shorter than that in a thermal-roller type, so that the fixing film is heated up from a room temperature to 190° C. which is a fixable temperature in 15 to 20 sec or so. Therefore, if the slow-up driving time is set to around 15 sec, both of the acceleration torque and the load torque at the start-up can be reduced, by which torque required at the start-up can be significantly reduced.

In the configuration of the electromagnetic induction heating type fixing apparatus in this embodiment, a heat generating portion is not located in the nip position, but in a slightly more upstream position as shown in FIGS. 2 and 6. While it is preferable to heat the heat-resistant grease on the rubbed nip portion directly in order to reduce the load torque, the nip portion cannot be heated up even if it is heated in the resting condition in the configuration of this embodiment. In this case, the slow-up rotation of the fixing film is very effective from the viewpoint of heating up the nip portion.

As described above, by starting a temperature control together with the slow-up driving of the fixing apparatus, driving torque required at the start of the driving of the fixing apparatus can be significantly reduced.

Next, another embodiment of the present invention will be described below.

Configurations of an image forming apparatus and a fixing apparatus in this embodiment are the same as those of the above embodiment, and therefore a description of these configurations is omitted here.

This embodiment is characterized by a change of a driving time for the fixing apparatus at slow-up driving according to a temperature of the fixing film 10 before starting the driving.

If the fixing film 10 is not cooled down completely like the condition in which so much time is not elapsed after an end of printing, a viscosity of the grease coated inside the fixing film is low and the load torque is small. In this condition, more driving torque can be allocated to the acceleration torque in comparison with driving torque allocated at rising from a completely cooled condition of the fixing apparatus. Therefore, by using a control pattern in which time required for the slow-up driving immediately after a start of rotator driving is changed according to a temperature of the fixing film 10 before starting the rotative driving, the time required for the slow-up driving can be reduced to the minimum together with significantly reducing a driving torque required at the start of driving the fixing apparatus.

Figure 15:
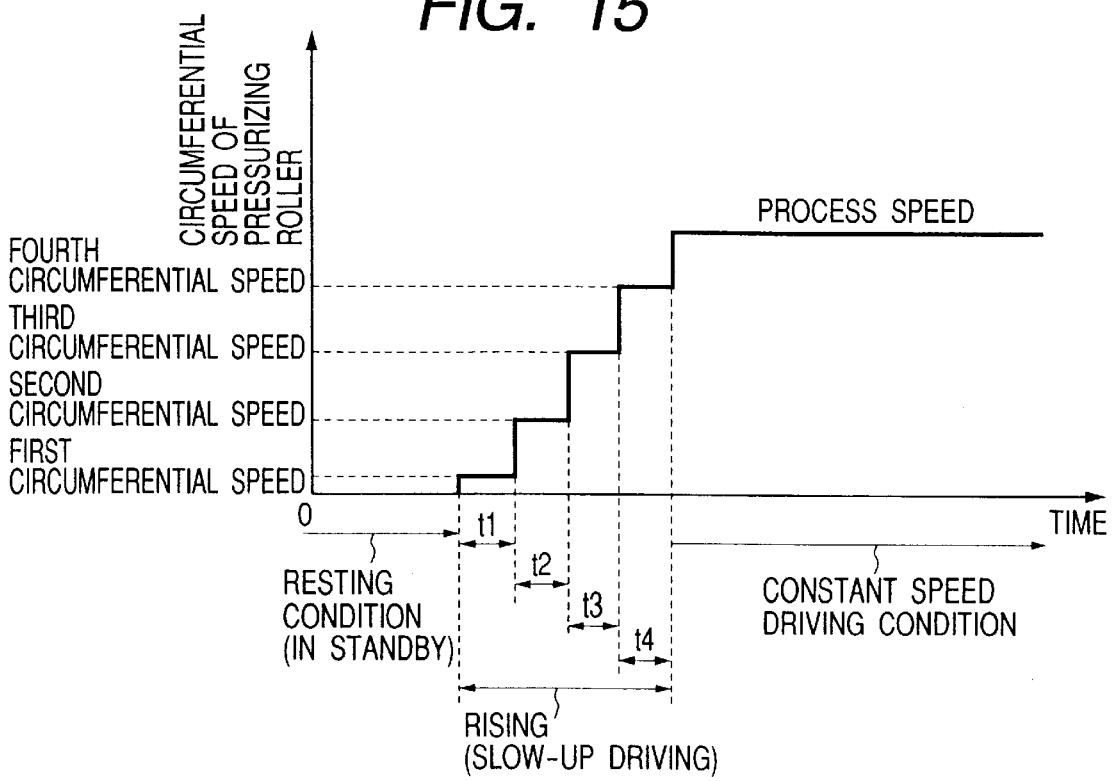
FIG. 15 is a diagram showing a driving control pattern of a pressuring roller according to another embodiment.

First, FIG. 15 shows a driving control pattern of the fixing apparatus at the start of the rotative driving in this embodiment. This pattern is the same as that of the control shown in FIG. 14 in the above embodiment in that a circumferential speed increases in steps. In the driving control pattern of this embodiment, the circumferential speed of the pressurizing roller under the slow-up driving is divided into four grades for acceleration in steps. These steps are referred to as a first circumferential speed, a second circumferential speed, a third circumferential speed, and a fourth circumferential speed from a low speed side, respectively.

While these four circumferential speeds are appropriately combined with each other according to a temperature of the fixing film 10 in this embodiment, it is also possible to accelerate the circumferential speeds linearly or nonlinearly relative to time. Furthermore, the above patterns can be combined for acceleration by a driving control including an acceleration in steps.

Figure 16:
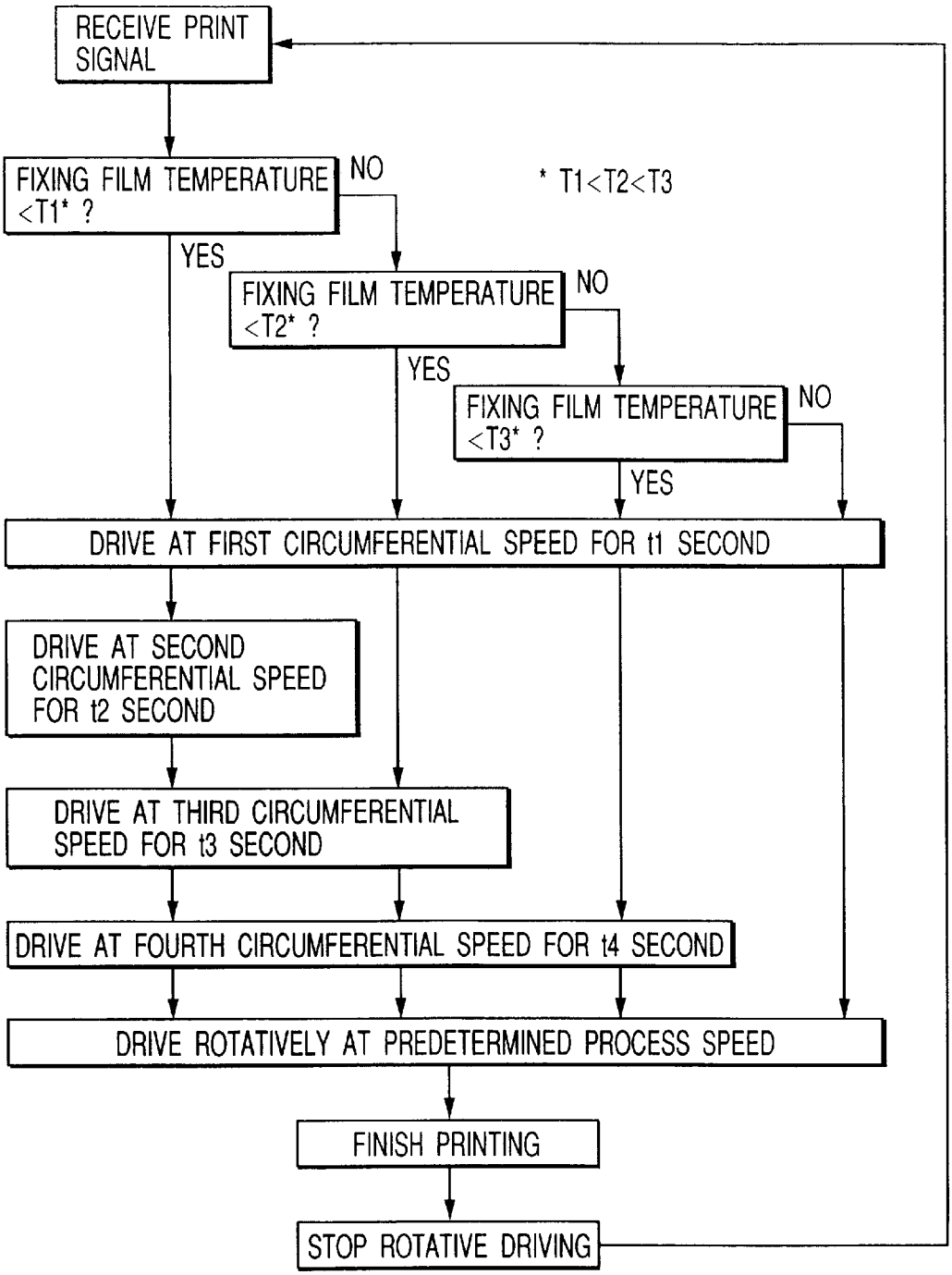
FIG. 16 is a chart showing a driving control sequence of a pressurizing roller.

Next, FIG. 16 shows a chart of a sequence of a driving control at the start of the rotative driving in this embodiment.

First, when a print signal is inputted to the image forming apparatus body, the pressurizing roller 30 starts the rotative driving. At this time, the image forming apparatus body recognizes a temperature of the fixing film by means of a signal from a temperature detecting element. The recognized temperature of the fixing film is compared with preset temperatures (° C.) T1, T2, and T3 (T1>T2>T3). Then it classifies the recognized temperature of the fixing film into four grades; lower than T1, more than or equal to T1 and less than T2, more than or equal to T2 and less than T3, and more than or equal to T3.

Then, first of all, rotative driving is performed for t1 sec at the lowest first rotational speed independently of a temperature of the fixing film 10. The first circumferential speed is used for reducing torque immediately after the rotative driving. Therefore, it is preferably the minimum speed.

If the temperature of the fixing film at the start of the driving is lower than T1° C., the circumferential speed is switched to the second circumferential speed for driving for t2 sec afterward, then it is switched to the third circumferential speed for driving for t3 sec and afterward to the fourth circumferential speed for driving for t4 sec. Finally after t1+t2+t3+t4 sec from the start of the driving, the speed is switched to a predetermined process speed to complete the slow-up driving.

If the temperature of the fixing film at the start of the driving is more than or equal to T1° C. and less than T2° C., a step of driving at the second circumferential speed is skipped and the speed is switched to the third circumferential speed for driving for three sec and then switched to the fourth circumferential speed for driving for four sec. Finally after t1+t3+t4 sec from the start of the driving, the speed is switched to the predetermined process speed to complete the slow-up driving.

If the temperature of the fixing film at the start of the driving is more than and equal to T2° C. and less than T3° C., steps of driving at the second and third circumferential speeds are skipped and the speed is switched to the fourth circumferential speed for driving for four sec. Finally after t1+t4 sec from the start of the driving, the speed is switched to the predetermined process speed to complete the slow-up driving.

If the temperature of the fixing film at the start of the driving is equal to or more than T3° C., steps of driving at the second, third, and fourth circumferential speeds are skipped and immediately the speed is switched to the predetermined process speed. In other words, after t1 sec from the start of the driving, the slow-up driving is completed.

While the circumferential speeds under the slow-up driving and the film temperatures are previously classified into four grades in this embodiment, the number of these grades is appropriately determined according to a fixing apparatus. It is also possible to change each driving time for the preset circumferential speeds under the slow-up driving in such a way that it is associated with each temperature of the fixing film.

In addition, the circumferential speed of the pressurizing roller can be continuously varied linearly or nonlinearly at realtime so as to be associated with a temperature of the fixing film.

As described in the above, by changing a driving time for the fixing apparatus according to a temperature of the fixing film 10 previous to the start of the driving, the driving torque required at the start of the driving of the fixing apparatus can be lowered while reducing a time required for the slow-up driving to a minimum.

Next, still another embodiment of the present invention will be described below.

A configuration of an image forming apparatus in this embodiment is the same as that in the above embodiment, and therefore its description is omitted here.

Figure 17:
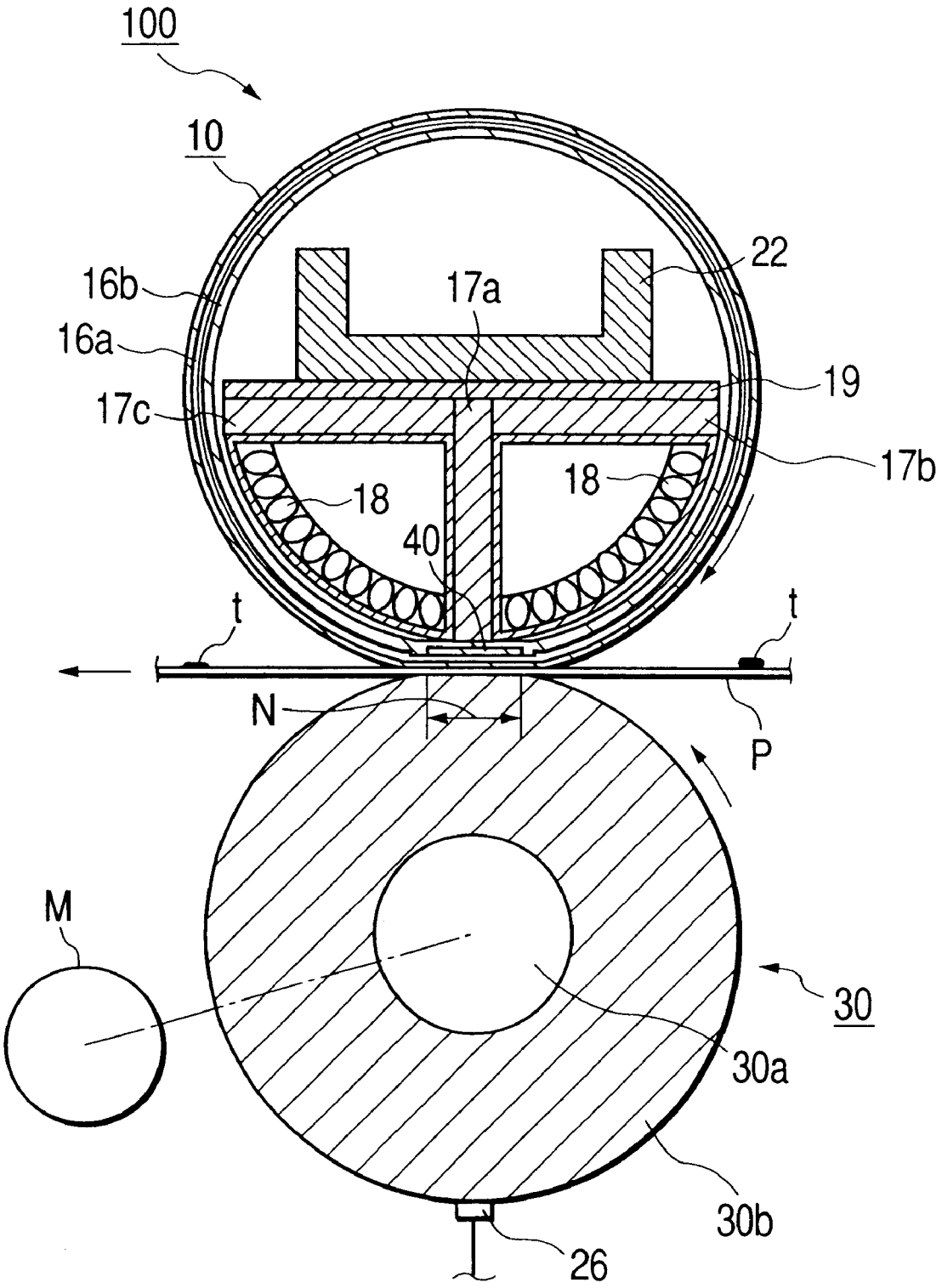
FIG. 17 is a sectional side elevation view of an image heating apparatus according to another embodiment.

Referring to FIG. 17, there is shown a sectional side elevation typical view of a main portion of an electromagnetic induction heating type fixing apparatus in this embodiment. In this configuration of this embodiment, a heat generating portion is arranged in the nip portion N or in the vicinity thereof. In the same manner as for the above embodiment, a driving control for a fixing apparatus 200 at the slow-up driving can be performed in any driving control pattern shown in FIGS. 12 to 14 or in their combination pattern in the same manner as for the above embodiment.

This embodiment is characterized by a temperature rise of the fixing film 10 by previously starting the temperature control before the start of the rotative driving of the pressurizing roller 30 in the fixing apparatus having the above configuration. In the fixing apparatus 200 according to this embodiment, the heat generating portion is in the vicinity of the nip portion N, and therefore by starting the temperature control in a resting condition, it becomes possible to increase temperatures of members around the nip portion N rubbed by the fixing film 10 and the good heat conducting member 40.

Accordingly, the viscosity of the heat-resistant grease applied to the inner surface of the fixing film of the nip portion N can be reduced and the load torque be lowered before the slow-up driving of the pressurizing roller 30 is started. Accordingly, a slip of the film can be reliably prevented.

As described above, by starting the slow-up driving after heating up the fixing film 10 in the resting condition, the driving torque required at the start of driving the fixing apparatus can be significantly reduced even if the fixing apparatus 200 is cooled.

In the induction heating type fixing apparatus as described in this embodiment, only the heat generating portion is heated up to the vicinity of 300° C. in several sec or so and the fixing film 10 may be destroyed with heat if it is powered in the resting condition without lowering the power, for example, 1000 W or greater power is supplied. Therefore, more preferably an input power in the resting condition of the fixing apparatus is controlled to be reduced to about 500 W or lower.

As set forth in the above, the fixing film 10 is previously heated up before the slow-up driving of the pressurizing roller 30, by which the driving torque required at the start of driving the fixing apparatus can be significantly reduced.

It is possible to apply the above control method of driving the pressurizing roller after the heat-up of the film to the image heating apparatus having the configuration shown in FIG. 2.

Figure 23:
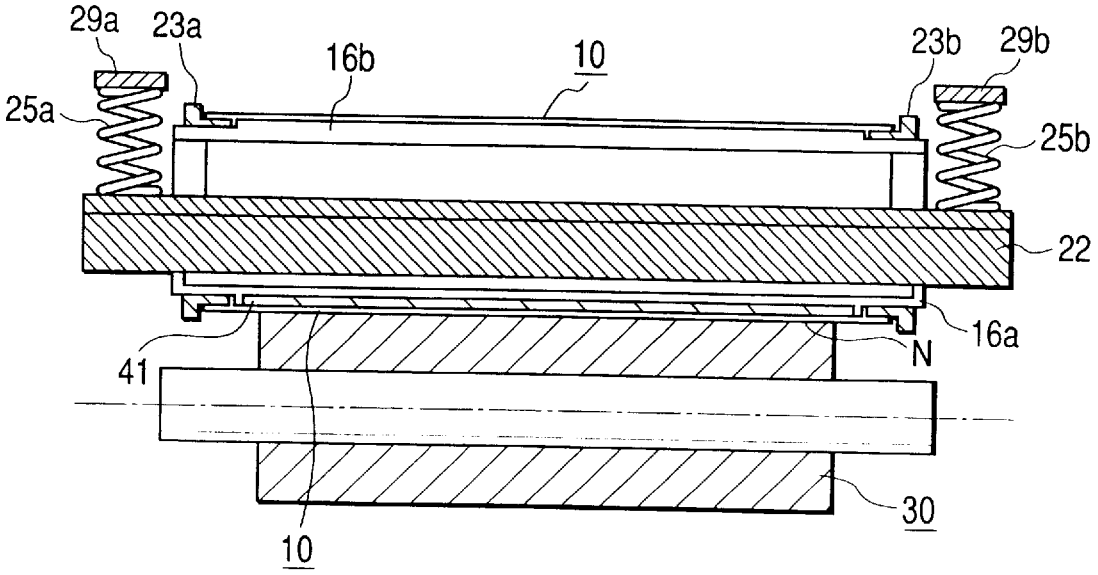
FIG. 23 is a front sectional view of the image heating apparatus in FIG. 22.
Figure 22:
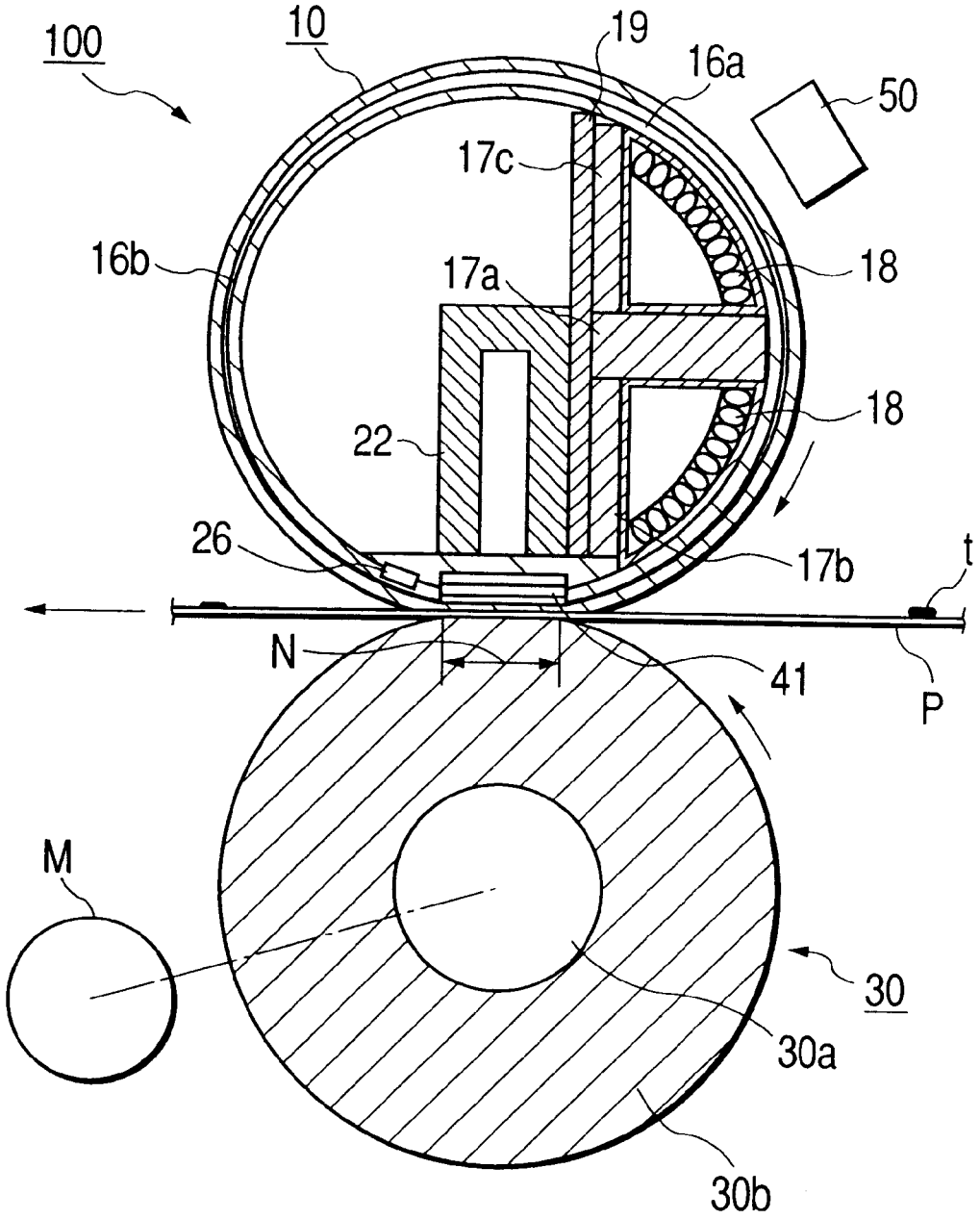
FIG. 22 is a sectional side elevation view of an image heating apparatus according to another embodiment.

While the good heat conducting member is arranged in the above embodiment, it is also possible to arrange the guide members 16*a* and 16*b* over the circumference without an arrangement of the good heat conducting member as shown in FIGS. 22 and 23 and to arrange a sliding member (slipping member) 41 which is a supporting member in a resting and fixed condition in a position corresponding to the nip N portion of the guide members 16*a* and 16*b*, so that the film moves in contact with this sliding member 41.

The electromagnetic induction heating type fixing belt 10 can also has a configuration not having the elastic layer 2 if it is used for heating and fixing a monochrome or single-path multi-color image. The electromagnetic induction heat generating layer 1 can be composed of resin including metal filler. It can also be a member of a single electromagnetic induction heating layer.

The configuration of the fixing apparatus as a heating apparatus is not limited to the pressurizing roller driving type in this embodiment.

Figure 18:
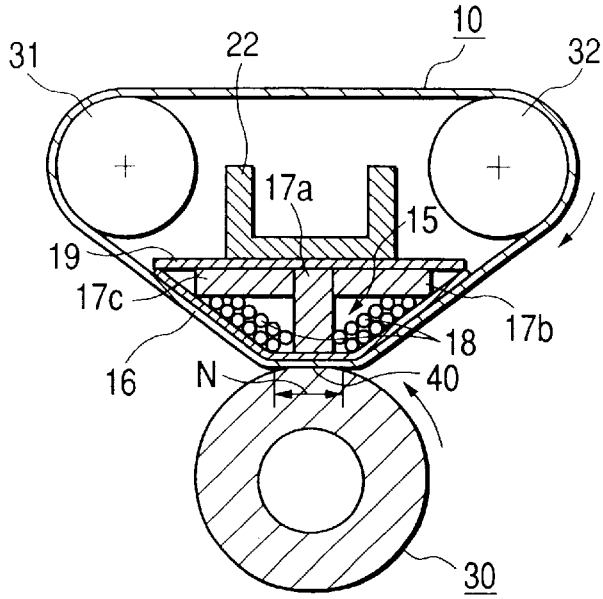
FIG. 18 is a sectional side elevation view of an image heating apparatus according to still another embodiment.

For example, as shown in FIG. 18, the electromagnetic induction heating type fixing belt 10 in an endless belt form is suspended between the belt guide 16, the driving roller 31, and the tension roller 32, and the bottom portion of the belt guide 16 and the pressurizing roller 30 as a pressurizing member are contacted by a pressure with the fixing belt 10 therebetween to form the fixing nip portion N, by which the fixing belt 10 can be driven rotatively by the driving roller 31. In this case, the pressurizing roller 30 is a follower rotating roller.

The pressurizing member 30 is not limited to a roller, but there can be a member having another form such as a rotary belt.

In addition, to supply heat energy to the recording material from the pressurizing member 30 side, electromagnetic induction heating or other heating means can also be arranged in the pressurizing member 30 side for heat-up and temperature control to a predetermined temperature.

A use of the heating apparatus of the present invention is not limited to the image heating and fixing apparatus of this embodiment, but it can be widely used as means or an apparatus for heating heated material such as an image heating apparatus for improving a quality of gloss or other surface properties by heating a recording material bearing an image, an image heating apparatus for temporary fixing, an apparatus for heating and drying heated material, or a heat laminating apparatus.

As described above, in the fixing apparatus having a configuration in which the rotator is slid over its supporting member in the nip portion according to the present invention, the driving roller is rotated at a low speed when its driving is started and therefore a step-out of the driving motor of the fixing apparatus can be prevented, and the driving torque required at the start of driving the rotator can be reduced by heating up the film, by which a driving motor with a smaller driving torque can be used so as to reduce a product cost.

Although the present invention has been described in its preferred embodiments, the present invention is not limited to the above embodiments and any changes can be resorted to within the scope of the technical idea of the present invention.

What is claimed is:

1. An image heating apparatus comprising:

a movable film;

magnetic flux generating means for generating magnetic flux, wherein eddy-current is caused in said film by the magnetic flux generated by said magnetic flux generating means, said film generates heat by the eddy-current, and an image on a recording material is heated by the heat of said film;

a statically fixed supporting member for supporting said film, wherein said film slides over said supporting member;

a driving member for driving said film; and controlling means for controlling a driving of said driving member, wherein said controlling means drives said driving member at a first speed when the driving is started and then drives said driving member at a second speed, and wherein said first speed is lower than said second speed.

2. An image heating apparatus according to claim 1, wherein said first speed increases linearly relative to time up to said second speed.

3. An image heating apparatus according to claim 1, wherein said first speed increases nonlinearly relative to time up to said second speed.

4. An image heating apparatus according to claim 1, wherein said first speed increases in steps relative to time up to said second speed.

5. An image heating apparatus according to claim 1, wherein said first speed is constant for a predetermined time.

6. An image heating apparatus according to claim 1, wherein said second speed is a speed at image heating.

7. An image heating apparatus according to claim 1, wherein lubricant is applied between said film and said supporting member, and said film generates heat when said driving member drives said film at the first speed.

8. An image heating apparatus according to claim 1, further comprising temperature detecting means for detecting a temperature of said film, wherein lubricant is applied between said film and said supporting member and wherein time for said first speed changes according to a detected temperature from said temperature detecting means.

9. An image heating apparatus according to claim 1, wherein said driving member is a roller and forms a nip with said supporting member via said film.

10. An image heating apparatus according to claim 9, wherein the recording material bearing an unfixed image in said nip is pinched and conveyed and the unfixed image is fixed onto the recording material.

11. An image heating apparatus according to claim 1, wherein said supporting member is a member having a superior slip property.

12. An image heating apparatus according to claim 1, wherein said film is endless.

13. An image heating apparatus, comprising:

a movable film;

magnetic flux generating means for generating magnetic flux;

wherein eddy-current is caused in said film by said magnetic flux generated by the magnetic flux generating means, said film generates heat by the eddy-current, and an image on a recording material is heated by the heat of said film, a statically fixed supporting member for supporting said film; and wherein said film slides on said supporting member via lubricant, a driving member for driving said film;

wherein said driving member drives said film after said film generates heat.

14. An image heating apparatus according to claim 13, wherein said driving member is a roller and forms a nip with said supporting member via said film.

15. An image heating apparatus according to claim 14, wherein the recording material bearing an unfixed image in said nip is pinched and conveyed and the unfixed image is fixed onto the recording material.

16. An image heating apparatus according to claim 13, wherein said supporting member is a member having a superior slip property.

17. An image heating apparatus according to claim 13, wherein said film is endless.

18. An image heating apparatus according to claim 13, wherein said driving member drives said film at a first speed when the driving is started and then drives said film at a second speed and wherein said first speed is lower than said second speed.

* * * * *

UNITED STATES PATENT AND TRADEMARK OFFICE

CERTIFICATE OF CORRECTION

PATENT NO. : 6,263,172 B1
DATED : July 17, 2001
INVENTOR(S) : Masahiro Suzuki et al.

It is certified that error appears in the above-identified patent and that said Letters Patent is hereby corrected as shown below:

Column 2,
Line 10, "N." should read -- N, --.
Line 49, "closely" should read -- close --.

Column 3,
Line 31, "a" (2nd occurrence) should read -- the --.
Line 35, "need be" should read --needs to be --.
Line 66, "further" should read -- a further --.

Column 5,
Line 30, "an" should read -- a --.
Line 31, "an" should read -- a --.
Line 32, "an" should read -- a --.
Line 54, "an" should read -- a --.

Signed and Sealed this

Twenty-sixth Day of February, 2002

*Attest:*

*Attesting Officer*

JAMES E. ROGAN
*Director of the United States Patent and Trademark Office*